US011365510B2

(12) United States Patent
Kim et al.

(10) Patent No.: US 11,365,510 B2
(45) Date of Patent: Jun. 21, 2022

(54) IRON DEVICE, CLOTHES CARE APPARATUS AND CONTROL METHOD THEREOF

(71) Applicant: SAMSUNG ELECTRONICS CO., LTD., Suwon-si (KR)

(72) Inventors: Bongku Kim, Suwon-si (KR); Dongwoo Lee, Suwon-si (KR); Byoungchul Kim, Suwon-si (KR); Daejung Yoon, Suwon-si (KR); Wonkyu Lim, Suwon-si (KR); Haesoo Cho, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 50 days.

(21) Appl. No.: 16/897,537

(22) Filed: Jun. 10, 2020

(65) Prior Publication Data

US 2020/0385916 A1 Dec. 10, 2020

(30) Foreign Application Priority Data

Jun. 10, 2019 (KR) ..... 10-2019-0068159

(51) Int. Cl.
*D06F 71/04* (2006.01)
*D06F 71/34* (2006.01)
(Continued)

(52) U.S. Cl.
CPC ..... *D06F 71/04* (2013.01); *D06F 71/34* (2013.01); *D06F 71/36* (2013.01); *D06F 71/40* (2013.01); *D06F 73/00* (2013.01)

(58) Field of Classification Search
CPC ..... D06F 71/02; D06F 71/023; D06F 71/026; D06F 71/043; D06F 71/046;
(Continued)

(56) References Cited

U.S. PATENT DOCUMENTS 3,216,134 A * 11/1965 Salinett ..... D06F 71/065 38/41
3,279,106 A * 10/1966 Tucker ..... D06F 71/026 38/40
(Continued)

FOREIGN PATENT DOCUMENTS

KR 20-0201898 Y 11/2000
KR 10-0444005 B1 11/2004
(Continued)

OTHER PUBLICATIONS

International Search Report dated Sep. 24, 2020, in corresponding International Patent Application No. PCT/KR2020/006864.

*Primary Examiner* — Ismael Izaguirre
(74) *Attorney, Agent, or Firm* — Staas & Halsey LLP

(57) ABSTRACT

Provided is an iron device. The iron device includes a base provided with a heat generator; a press plate arranged to pivot between a first position at which the press plate covers the base and a second position at which the press plate uncovers the base; a steam nozzle arranged to, with the press plate being in the first position, supply steam to a space between the base and the press plate; and a press driver configured to, with the press plate being in the first position, mechanically move the press plate in a first direction toward the base and second direction away from the base.

20 Claims, 29 Drawing Sheets

(51) Int. Cl.
*D06F 71/36* (2006.01)
*D06F 71/40* (2006.01)
*D06F 73/00* (2006.01)

(58) Field of Classification Search
CPC ..... D06F 71/062; D06F 71/065; D06F 71/06; D06F 71/04; D06F 71/34; D06F 71/40; D06F 71/28; D06F 71/29; D06F 71/295; D06F 73/00; D06F 73/02
See application file for complete search history.

(56) References Cited

U.S. PATENT DOCUMENTS 3,290,807 A * 12/1966 Esaka ..... A47G 25/72 38/71
3,491,469 A * 1/1970 Niehenke ..... D06F 71/29 38/71
3,593,440 A * 7/1971 Schlemon ..... D06F 71/34 38/16
4,953,300 A * 9/1990 Davidson ..... D06F 71/026 38/15
6,151,814 A * 11/2000 Raio ..... D06F 71/026 38/30
2009/0126422 A1 5/2009 Kim et al.

FOREIGN PATENT DOCUMENTS

KR 10-2010-0067780 6/2010
KR 10-1295379 8/2013
KR 10-2015-0009718 1/2015
KR 10-2015-0065297 A 6/2015
KR 10-2016-0075032 A 6/2016
WO WO 9402057 A1 * 2/1994

* cited by examiner

IRON DEVICE, CLOTHES CARE APPARATUS AND CONTROL METHOD THEREOF

CROSS-REFERENCE TO RELATED APPLICATION

This application is based on and claims priority under 35 U. S. C. § 119 to Korean Patent Application No. 10-2019-0068159 filed on Jun. 10, 2019, the disclosure of which is incorporated herein by reference in its entirety.

BACKGROUND

1. Field

The disclosure relates to an iron device, a clothes care apparatus, and a control method thereof, and more particularly, to an iron device having a crease creation and/or wrinkle-free function, a clothes care apparatus, and a control method thereof.

2. Discussion of Related Art

A clothes care apparatus generally refers to a device for handling clothes by washing or drying the clothes. Among the clothes care apparatuses, a clothes care apparatus with a drying function may include a hot air supplier for supplying hot air into a chamber for containing clothes to dry clothes, and a steam generator for performing a refresh function such as creasing, removing wrinkles, deodorizing, removing static electricity from the clothes.

The clothes care apparatus is shaped like a cabinet with the chamber containing the clothes. The chamber for containing the clothes is formed in the upper portion of the cabinet, and a machine room is arranged under the chamber to contain e.g., the steam generator or the hot air supplier. The chamber and the machine room may be separated by a partition wall.

The clothes care apparatus may include a clothes supporting member arranged in the chamber for holding the clothes. The clothes care apparatus may handle the clothes through translation and/or rotation of the clothes supporting member, or by supplying air current to the clothes supporting member.

In the meantime, the clothes care apparatus may include an iron device to create creases on or remove wrinkles from the clothes.

SUMMARY

The disclosure provides a clothes care apparatus equipped with an iron device with enhanced crease creation or wrinkle-free performance and control method thereof.

According to an aspect of the disclosure, an iron device includes a base equipped with a heat generator; a press plate arranged to pivot between a first position at which the press plate covers the base and a second position at which the press plate uncovers the base; a steam nozzle arranged to, with the press plate being in the first position, supply steam to a space between the base and the press plate; and a press driver configured to, with the press plate being in the first position, mechanically move the press plate in a first direction toward the base and second direction away from the base.

The heat generator may be arranged so that, with the press plate being in the first position, the heat generator faces the press plate.

The steam nozzle may be provided in the form of a steam injection hole passing through the base or the press plate.

The press plate may include a first clothes fixing member located at a top portion of the press plate to fix an end of a clothes to be ironed by the iron device; and a second clothes fixing member movably arranged at a bottom portion of the press plate to fix a portion of the clothes.

The iron device may further include a third clothes fixing member arranged to fix a bottom portion of the clothes fixed by the first and second clothes fixing members and including a forcing member.

The press plate has a first end and a second end opposite to the first end, the first end of the press plate is coupled to the press driver, the base may include a plate fixing member arranged to, with the press plate being in the first position, fix the second end of the press plate, and the plate fixing member may be provided to be movable along with the press plate when the press plate is moved in the first and second directions.

The press plate may include a cushion part arranged to, with the press plate being in the first position, be on a side of the press plate facing the base.

The base may include a press guide arranged to guide movement of the press plate in the first and second directions.

The press driver may include a driving source; a first gear to receive power from the driving source; a second gear interlocked with the first gear; a pinion gear arranged to be rotated with the second gear; a rack gear interlocked with the pinion gear; and a press hinge arranged at an end of the rack gear to pivotally support the press plate.

The press driver may pivotally support the press plate.

The iron device may further include at least one processor configured to control the press driver to move the press plate in the first direction and the second direction.

According to another aspect of the disclosure, a clothes care apparatus includes a housing defining a chamber to contain a clothes; and an iron device detachably mountable on the housing, wherein the iron device includes a base that, with the iron device being mounted on the housing, is supported by the housing; a press plate that, with the iron device being mounted on the housing, is arranged to pivot between a first position at which the press plate covers the base and a second position at which the press plate uncovers the base; and a press driver that, with the iron device being mounted on the housing, is configured to pivotally support the press plate, and to, with the press plate being in the first position, move the press plate in a first direction toward the base and second direction away from the base.

The base may include a heat generator arranged so that, with the iron device being mounted on the housing and the press plate being in the first position, the heat generator faces the press plate.

The clothes care apparatus may further include a steam generating device, and with the iron device being mounted on the housing, the iron device may be arranged to receive steam generated by the steam generating device.

The iron device may include a steam nozzle arranged to, with iron device being mounted on the housing and the press plate being in the first position, supply the received steam to a space between the press plate and the base.

At least one of the base or the press plate may include a steam injection hole arranged to, with the iron device being mounted on the housing and the press plate being in the first position, supply the received steam to a space between the press plate and the base.

The housing may include a reinforcing frame arranged in a portion of the housing in which the iron device is mountable.

The housing may include a cabinet and a cabinet door pivotally coupled to the cabinet, and the iron device may be mountable on an inner side of the cabinet, an outer side of the cabinet, or the cabinet door.

The iron device, when mounted on the cabinet door, may include a wire part to supply power to the iron device, and arranged to pass through a first cabinet hinge which pivotally supports the cabinet door, and a steam hose to supply steam to the iron device, and arranged to pass through a second cabinet hinge which pivotally supports the cabinet door.

According to another aspect of the disclosure, a method of controlling a clothes care apparatus that includes a base provided with a heat generator, a press plate arranged to move between a first position at which the press plate covers the base and a second position at which the press plate uncovers the base, a steam nozzle arranged to, with the press plate being in the first position, supply steam to space between the base and the press plate, and a press driver configured to, with the press plate being in the first position, mechanically move the press plate in a first direction toward the base and a second direction away from the base, the method comprises: performing control by at least one processor of the clothes case apparatus to: with the press plate being in the first position, supply steam through the steam nozzle to a space between the press plate and the base, after initiating the supply of steam, mechanically move the press plate toward the base, after mechanically moving the plate toward the base, apply heat by the heat generator between the press plate and the base, and after initiating the application of the heat, mechanically move the press plate away from the base.

The method may further include preheating the heat generator while the steam is being supplied through the steam nozzle.

The placing of the clothes between the press plate and the base may include turning the press plate from a first position to cover the base to a second position unfolded from the base, placing the clothes on the press plate, and turning the press plate from the second position to the first position.

According to another aspect of the disclosure, a clothes care apparatus includes a housing defining a chamber to contain a clothes; a steam generating device arranged in the housing and configured to generate steam; and an iron device detachably mountable on the housing, wherein the iron device includes a base provided with a heat generator and that, with the iron device being mounted on the housing, is supported by the housing, a press plate that, with the iron device being mounted on the housing, is arranged to be movable in a first direction toward the base and a second direction away from the base, a press driver that, with the iron device being mounted on the housing, is arranged to mechanically move the press plate, and a steam nozzle that, with the iron device being mounted on the housing, is arranged to receive the steam generated by the steam generating device and inject the received steam between the base and the press plate from a side of the housing on which base is supported.

The steam nozzle may be a first steam nozzle, and the iron device may further include a second steam nozzle that, with the iron device being mounted on the housing, is arranged so as to be vertically separated from the first steam nozzle.

The press driver may pivotally supports the press plate.

BRIEF DESCRIPTION OF THE DRAWINGS

The above and other objects, features and advantages of the present disclosure will become more apparent to those of ordinary skill in the art by describing in detail exemplary embodiments thereof with reference to the accompanying drawings, in which.

DETAILED DESCRIPTION OF EXEMPLARY EMBODIMENTS

Figure 1:
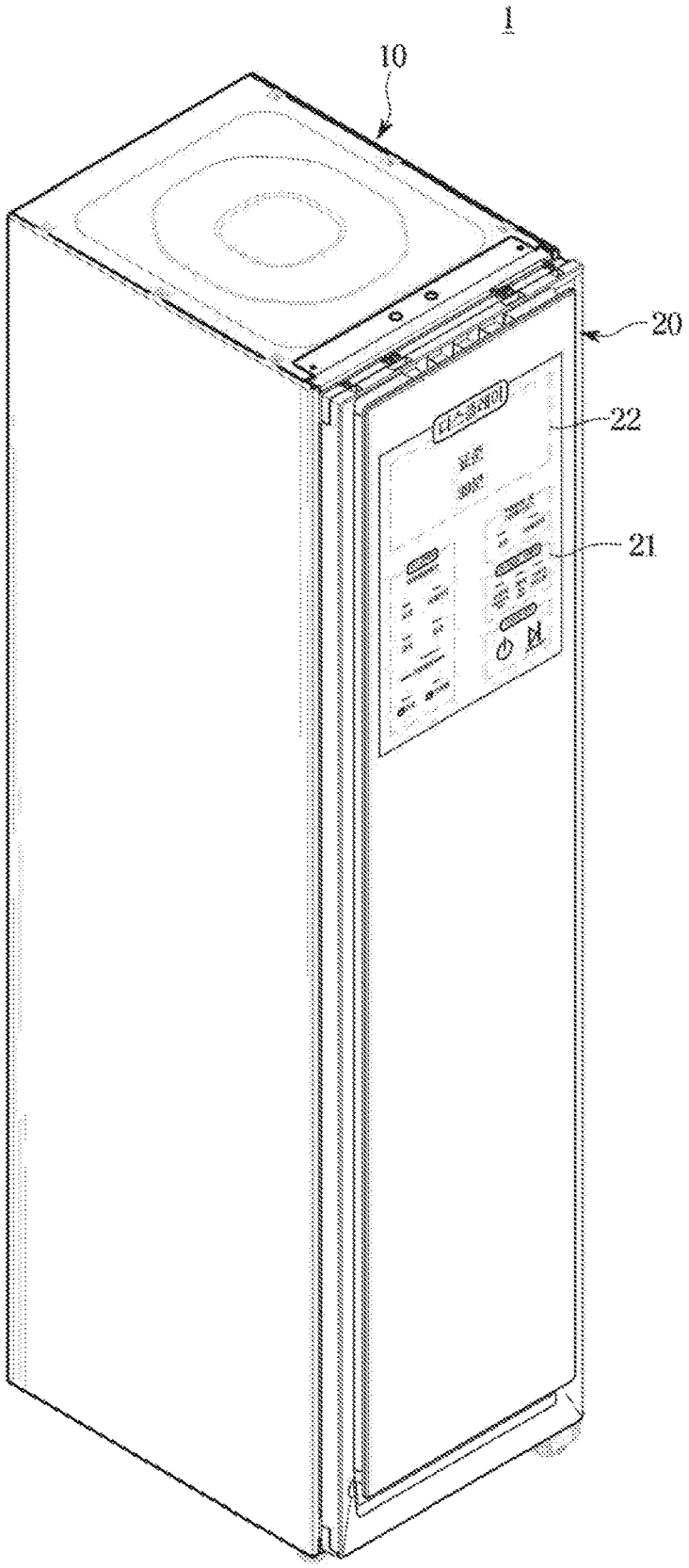
FIG. 1 shows a clothes care apparatus, according to an embodiment of the disclosure.

Embodiments and features as described and illustrated in the disclosure are merely examples, and there may be various modifications replacing the embodiments and drawings at the time of filing this application.

Throughout the drawings, like reference numerals refer to like parts or components.

The terminology used herein is for the purpose of describing particular embodiments only and is not intended to limit the disclosure. It is to be understood that the singular forms "a," "an," and "the" include plural references unless the context clearly dictates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The terms including ordinal numbers like "first" and "second" may be used to explain various components, but the components are not limited by the terms. The terms are only for the purpose of distinguishing a component from another. Thus, a first element, component, region, layer or chamber discussed below could be termed a second element, component, region, layer or section without departing from the teachings of the disclosure. Descriptions shall be understood as to include any and all combinations of one or more of the associated listed items when the items are described by using the conjunctive term "~and/or~," or the like.

The terms "front" and "rear" as herein used are defined with respect to the drawings, but the terms may not restrict the shape and position of the respective components.

Reference will now be made in detail to embodiments of the disclosure, which are illustrated in the accompanying drawings, wherein like reference numerals refer to the like elements throughout.

Figure 2:
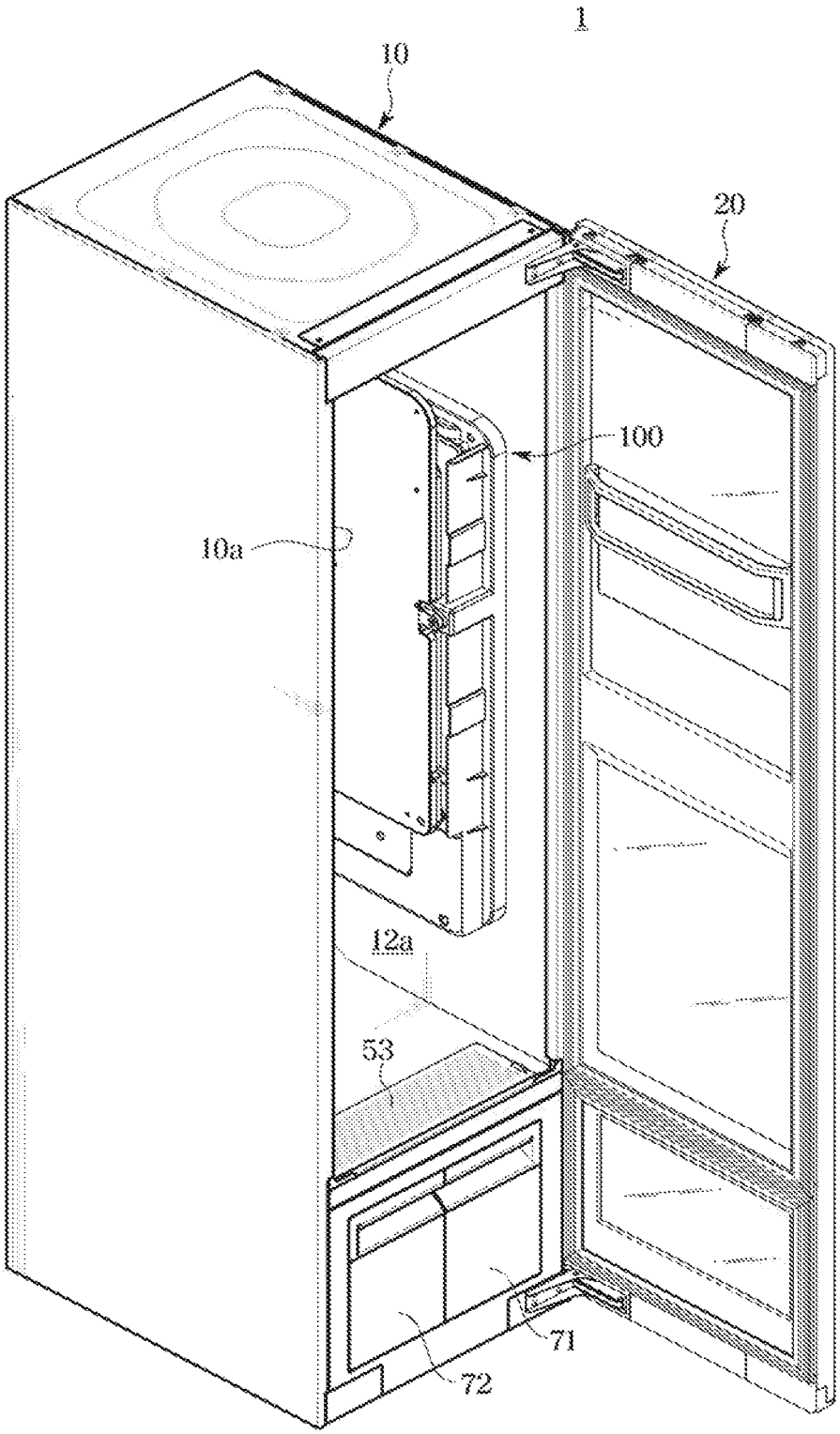
FIG. 2 shows the clothes care apparatus of FIG. 1 with a cabinet door open.
Figure 3:
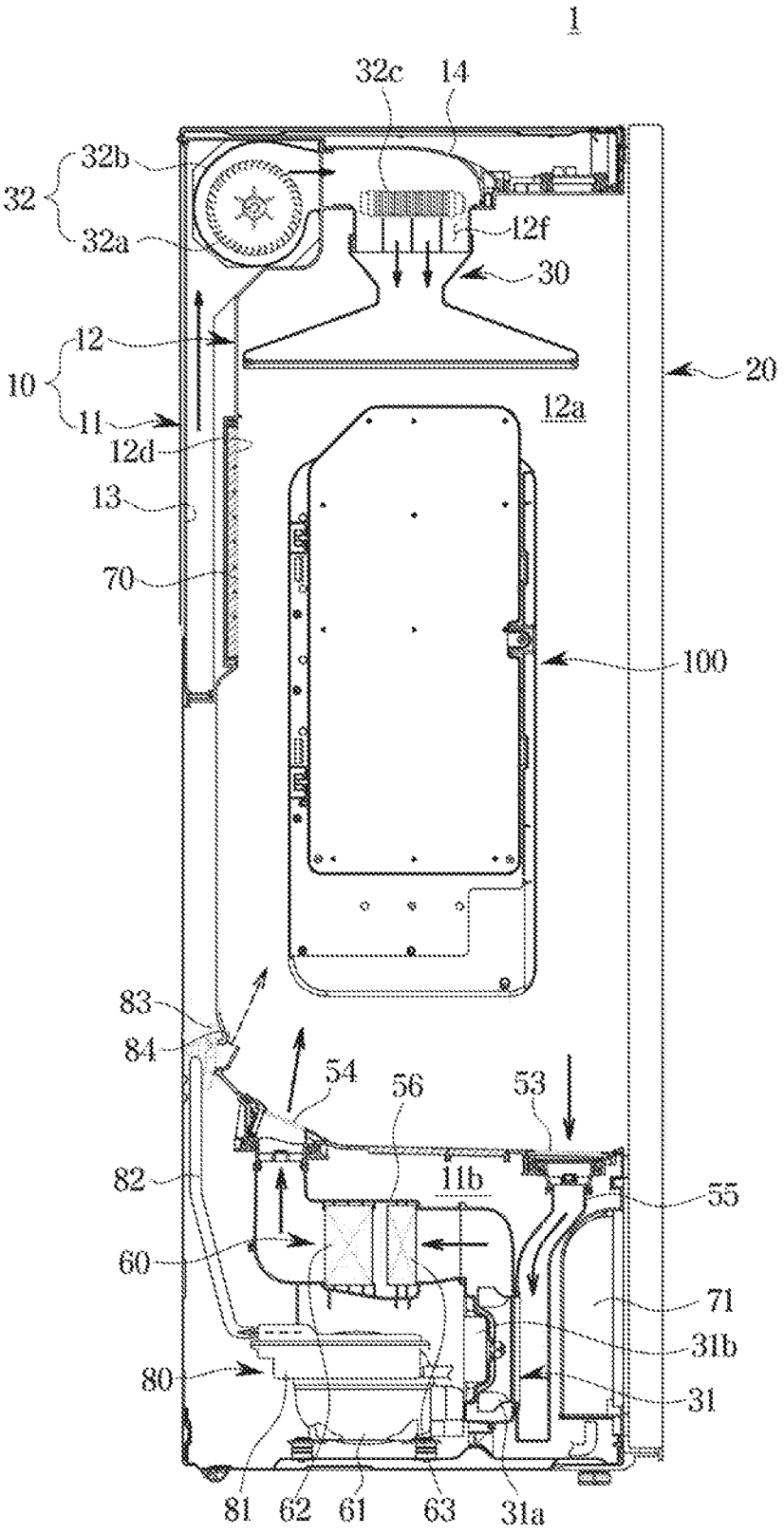
FIG. 3 is side cross-sectional view of the clothes care apparatus of FIG. 1.

FIG. 1 shows a clothes care apparatus, according to an embodiment of the disclosure. FIG. 2 shows the clothes care apparatus of FIG. 1 with its cabinet door open. FIG. 3 is side cross-sectional view of the clothes care apparatus of FIG. 1.

In the following embodiments of the disclosure, a direction in which a cabinet door 20 of a clothes care apparatus 1 is arranged and the opposite direction are defined as the front (direction) and the rear (direction), respectively.

Referring to FIGS. 1 to 3, the clothes care apparatus 1 may include a cabinet 10, a chamber 12*a* arranged in the cabinet 10 to contain the clothes, the cabinet door 20 pivotally coupled to the cabinet 10 to open or close the chamber 12*a*, and a clothes supporting member 30 provided in the chamber 12*a* to hold the clothes. The cabinet 10 and the cabinet door 20 may be collectively called a housing 10 and 20.

The cabinet 10 has the chamber 12*a* formed therein, and may be shaped like a hexahedron with one side open. An opening 10*a* may be formed on the front of the cabinet 10.

An input module 21 for receiving a control command for the clothes care apparatus 1 from the user and a display 22 for displaying a screen for guiding user inputs or a screen for displaying information about an operation of the clothes care apparatus 1 may be arranged on an outer side of the cabinet door 20, i.e., the front side of the clothes care apparatus 1.

For example, the input module 21 may be provided in the form of a button for receiving an input by pressure or a touch panel for receiving an input by touch. In the case that the input module 21 has the form of the touch panel, it is also possible to combine the input module 21 with the display 22 into a touch screen.

The cabinet 10 may include an outer frame 11, an inner frame 12 arranged inside the outer frame 11, and upper ducts 13 and 14 arranged between the outer frame 11 and the inner frame 12 to circulate air.

The inner frame 12 may separate the chamber 12*a* from a machine room 11*b*. A heat exchange device 60 that forms a refrigeration cycle may be arranged in the machine room 11*b*. The heat exchange device 60 may accommodate a compressor 61, a heat exchanger 62 and 63, and an expansion valve (not shown). The heat exchanger 62 and 63 may include a condenser 62 and an evaporator 63.

Furthermore, a lower blower device 31 may be arranged in the machine room 11*b* to suck air into the machine room 11*b* and force the air to flow into the chamber 12*a*.

The lower blower device 31 may include a lower motor 31*b* for generating rotational force and a lower fan 31*a* provided to be rotated by the lower motor 31*b*. For example, the lower fan 31*a* may be provided as a centrifugal fan to suck in air in the axial direction and discharge the air to the outside of the radial direction, but is not limited thereto. For example, another type of fan may also be used in another embodiment of the disclosure.

Furthermore, although one lower fan 31*a* is shown in FIG. 3, there may be a plurality of lower fans depending on the design.

A second inlet 53, a second outlet 54, and a steam outlet 84 may be provided on the top side of the machine room 11*b*, i.e., on the bottom side of the chamber 12*a*. The second inlet 53 may be arranged on the front and bottom of the chamber 12*a*, and the second outlet 54 and the steam outlet 84 may be arranged on the rear and bottom of the chamber 12*a*. Arrangement of the second inlet 53, the second outlet 54, and the steam outlet 84 may vary.

Lower ducts 55 and 56 provided to guide the air sucked in by the lower fan 31*a* may be arranged in the machine room 11*b*. The air inside the chamber 12*a* may be brought into the first lower duct 55 through the second inlet 53. The first lower duct 55 may have one end coupled to the second inlet 53 and the other end coupled to the lower fan 31*a* of the lower blower device 31. The air brought into the first lower duct 55 may be moved to the second lower duct 56 via the lower fan 31*a*.

The evaporator 63 and condenser 62 of the heat exchange device 60 may be arranged in the second lower duct 56. Furthermore, the machine room 11*b* may accommodate the compressor 61 of the heat exchange device 60. For example, the compressor 61 may be an inverter-compressor that has variable number of rotations or compression volume. The inverter-compressor may be able to change the compression volume by controlling the number of rotations, and control the heating value of the condenser 62 accordingly.

The evaporator 63 may absorb heat from the air in the second lower duct 56. Water in the air may be condensed through the evaporator 63, and the condensed water may be collected in a drain tub 72 through a certain path.

The condenser 62 may be arranged in the farther downstream than the evaporator 63 in an air flow path. The air with its humidity reduced while the air passes the evaporator 63 is heated while passing the condenser 62. The air that has passed the evaporator 63 and the condenser 62 has high temperature and low humidity. The high temperature and dry air may flow into the chamber 12*a* through the second outlet 54.

Specifically, the heat exchange device 60 may use the condenser 62 and the evaporator 63 arranged in the second lower duct 56 to eliminate moisture in the air moving by the lower fan 31*a*. Accordingly, high temperature and dry air may be released through the second outlet 54. Through this process, the inside of the chamber 12*a* may be dehumidified, thus drying the clothes in the chamber 12*a*.

Furthermore, the machine room 11*b* may accommodate a steam generating device 80. The steam generating device 80 may generate steam and supply the steam into the chamber 12*a* or an iron device 100 to create creases on the clothes, remove wrinkles from the clothes and deodorize the clothes.

The steam generating device 80 may include a steam generator 81 for receiving water from a water supply tub 71 to generate steam, and a steam supply pipe 82 for guiding the generated steam to a steam injector 83. The steam injector 83 may be arranged on the rear and bottom of the chamber 12*a*.

A steam heater may be installed inside the steam generator 81 to heat water.

The steam generated by the steam generating device 80 may be moved to the steam injector 83 and supplied into the chamber 12*a* through the steam outlet 84. In this case, the steam outlet 84 may be arranged on the rear and bottom of the chamber 12*a* and above the second outlet 54.

Coupling relations between the steam generating device 80 and the iron device 100 will be described in more detail later.

An upper blower device 32 may be arranged in an upper portion of the chamber 12*a*, and may include an upper motor (not shown) for generating rotational force, a pair of upper fans 32*a* provided to be rotated by the upper motor, and a pair of fan cases 32*b* arranged to contain the pair of upper fans 32*a*.

The upper motor may have a shaft protruding to either side, and both ends of the shaft may be coupled to the upper fans 32*a*, respectively. With this structure, a single upper motor may rotate the pair of upper fans 32*a*.

The pair of upper fans 32*a* may be provided as centrifugal fans to suck in air in the axial direction and discharge the air to the outside of the radial direction, but is not limited thereto. For example, another type of fan may also be used in another embodiment of the disclosure.

Furthermore, although one upper fan 32*a* is shown in FIG. 3, there may be a plurality of upper fans depending on the design.

The pair of fan cases 32*b* may have an intake (not shown) arranged on either side and an outlet (not shown) arranged on the front, to guide the air sucked in from either side toward the front.

A first inlet 12*d* may be arranged on the rear side of the chamber 12*a* to forcing the air in the chamber 12 to flow into the upper ducts 13 and 14. A filter module 70 may be arranged in the first inlet 12*d*. The filter module 70 may include a dust filter for capturing dust and a deodorization filter that decomposes odor particles.

A first outlet 12*f* may be arranged on the top of the chamber 12*a* for releasing the air of the upper ducts 13 and 14 into the chamber 12*a*.

When the upper fan 32*a* is rotated, the air in the chamber 12*a* may flow into the first upper duct 13 through the first inlet 12*d*. When the air inside the chamber 12*a* flows into the first upper duct 13, foreign materials such as fine dust contained in the air inside the chamber 12*a* may be eliminated by the dust filter of the filter module 70, and the odor particles contained in the air inside the chamber 12*a* may be decomposed by the deodorization filter.

The air flowing into the first upper duct 13 may be moved up the first upper duct 13 and may be sucked into the upper fan 32*a*. The air released from the upper fan 32*a* may move along the second upper duct 14 and flow into the chamber 12*a* through the first outlet 12*f* arranged on the top of the chamber 12*a*.

The first upper duct 13 may be installed such that its lower end is coupled to the rear and bottom of the chamber 12*a* and its upper end covers the upper blower device 32. The second upper duct 14 is installed such that its rear end is coupled to the upper blower device 32 and its front end covers the outer top of the chamber 12*a*, and coupled to the first outlet 12*f*.

The first outlet 12*f* may include a first inner outlet (not shown) to release the air to the inside of the clothes supporting member 30, and first outer outlets (not shown) arranged on either side of the first inner outlet to release the air to the either side of the clothes held by the clothes supporting member 30.

In a case that the clothes supporting member 30 is provided in the plural in the chamber 12*a*, the first outlet 12*f* may be formed for each of the plurality of clothes supporting members 30, and air release may be controlled separately for each clothes supporting member 30.

A heater 32*c* may be arranged in the second upper duct 14 to heat air. As the air moved by the upper fan 32*a* passes the heater 32*c*, hot air may be brought into the chamber 12*a* through the first outlet 12*f* Although the heater 32*c* is shown in FIG. 3, the clothes care apparatus 1 may include a heat exchanger (not shown) in the place of the heater 32*c*, to get rid of moisture in the air moved by the upper fan 32*a*. In this case, the heat exchanger may include a compressor, a condenser, an evaporator, etc.

The drain tub 72 and the water supply tub 71 may be installed in a lower portion of the cabinet 10 to be detachable from the cabinet 10. The drain tub 72 and the water supply tub 71 may be arranged under the chamber 12*a*.

The drain tub 72 may be provided to easily take care of the condensed water produced from the chamber 12*a*. The drain tub 72 may collect many different kinds of condensed water produced from the clothes care apparatus 1. The drain tub 72 may be detachably mounted on the cabinet 10 to easily take care of the collected water.

Water required to generate steam in the steam generating device 80 may be stored in the water supply tub 71. The water stored in the water supply tub 71 is supplied to the steam generating device 80 and used to produce steam. The water supply tub 71 may be installed to be detachable from the cabinet 10 for easy water replenishment.

The drain tub 72 and the water supply tub 71 may be arranged in front of the machine room 11*b*. The machine room 11*b* is arranged in a lower portion of the cabinet 10. The machine room 11*b* is arranged under the chamber 12*a*.

The iron device 100 may be arranged in the chamber 12*a* of the cabinet 10.

Figure 4:
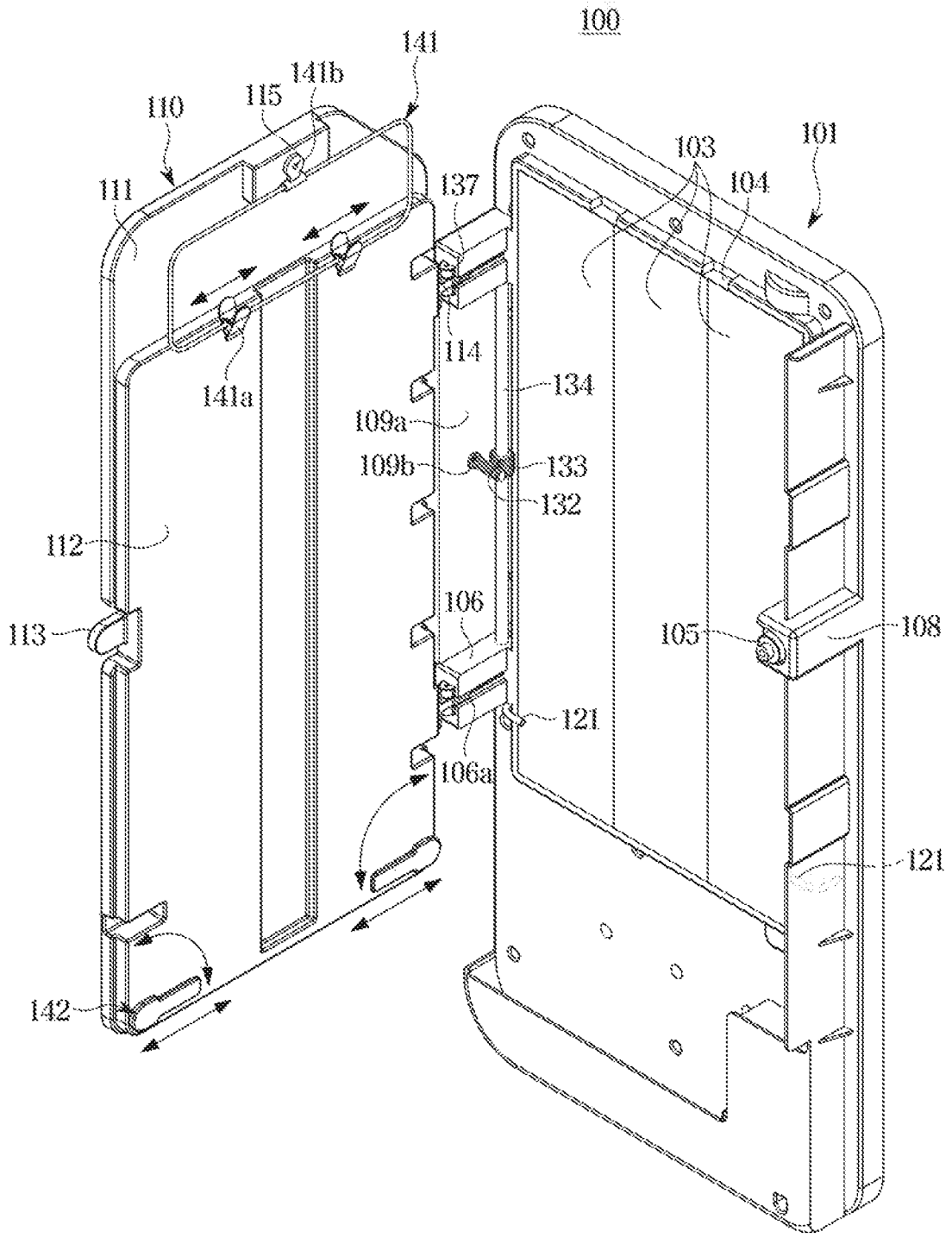
FIG. 4 shows an iron device shown in FIG. 2 with a press door open.
Figure 5:
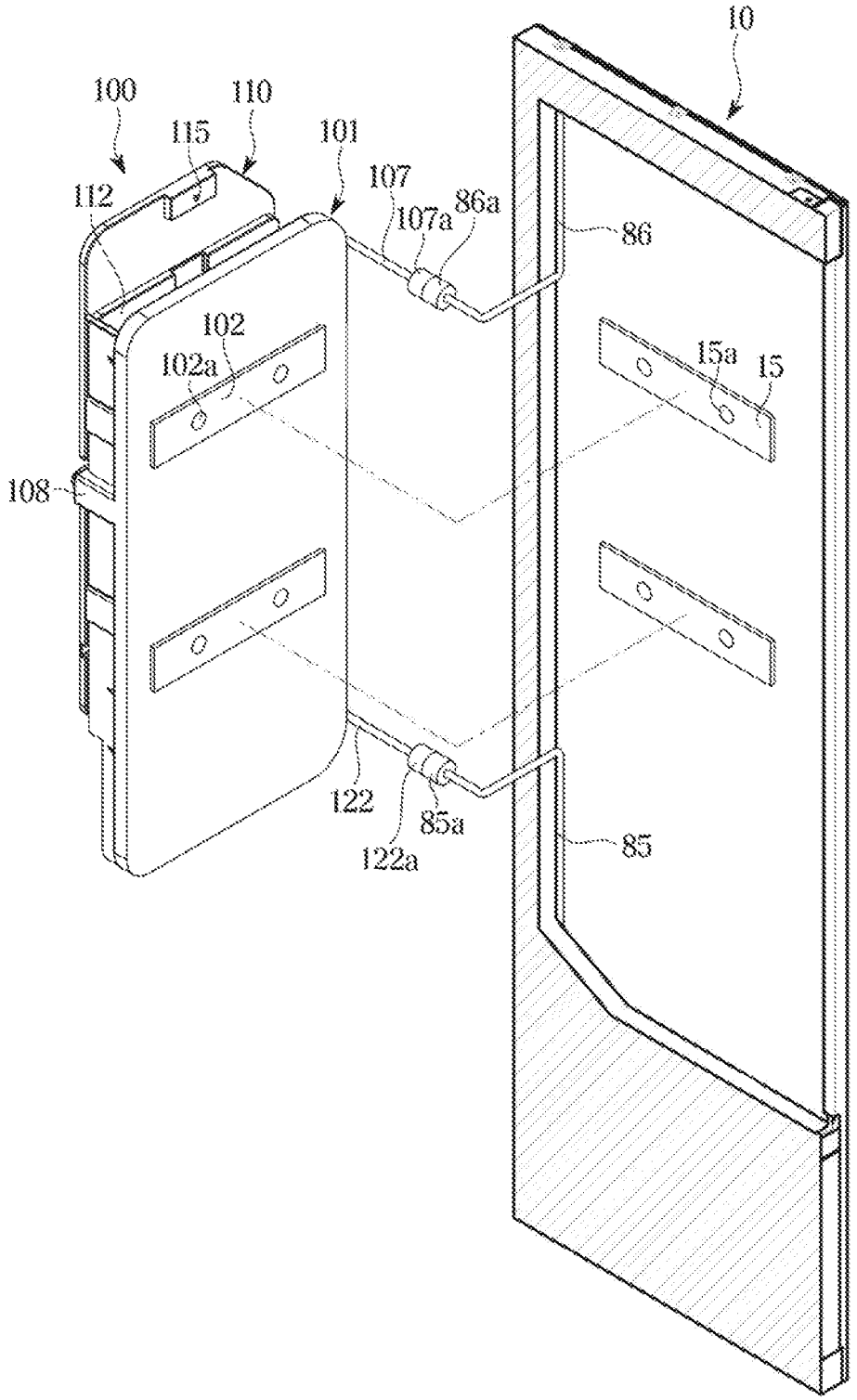
FIG. 5 shows combining of the iron device shown in FIG. 2 with the cabinet, according to an embodiment of the disclosure.
Figure 6:
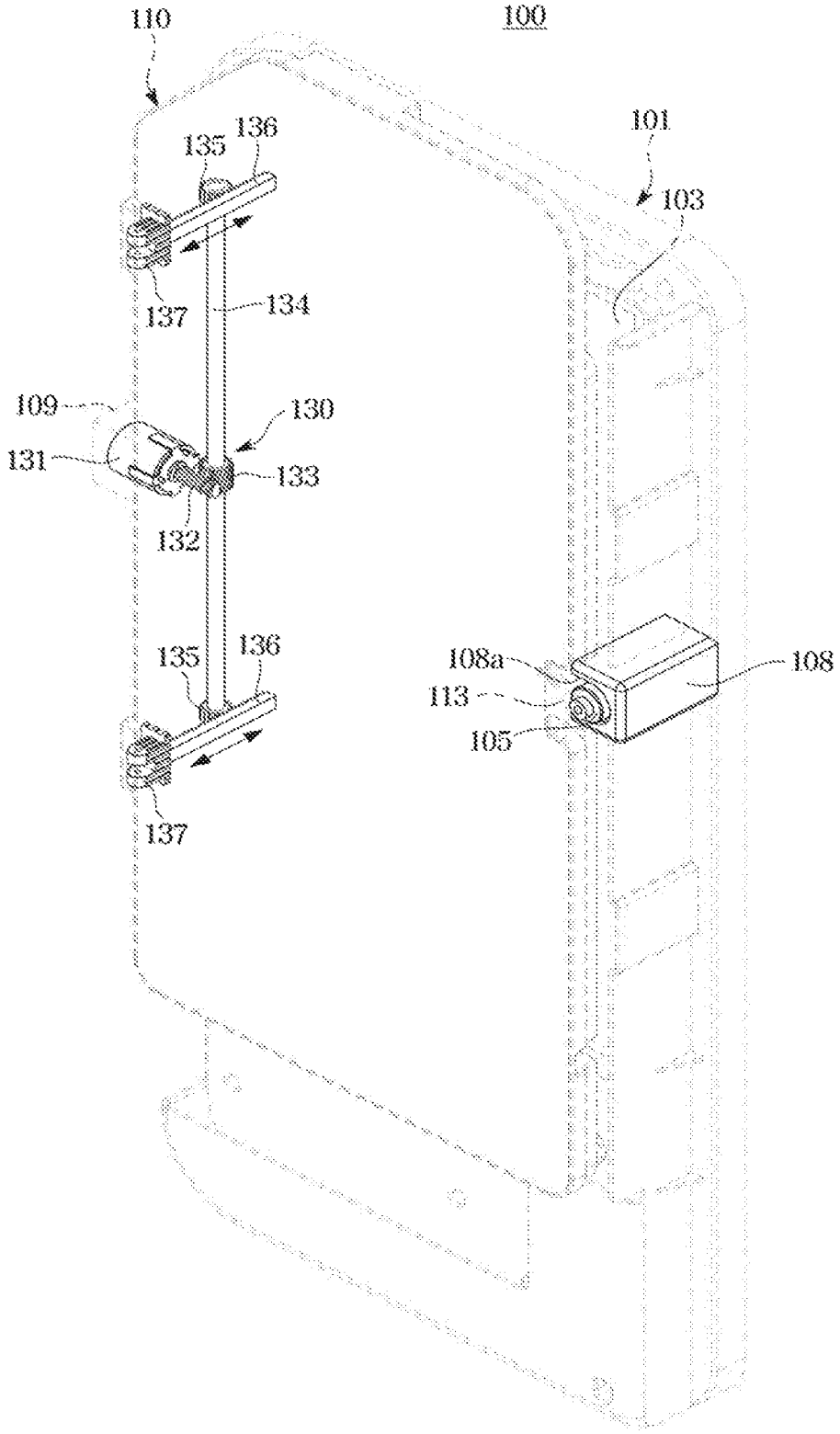
FIG. 6 shows a press driver of the iron device shown in FIG. 4, according to an embodiment of the disclosure.

FIG. 4 shows an iron device shown in FIG. 2 with a press door open. FIG. 5 shows combining of the iron device shown in FIG. 2 with the cabinet, according to an embodiment of the disclosure. FIG. 6 shows a press driver of the iron device shown in FIG. 4, according to an embodiment of the disclosure.

Referring to FIGS. 4 and 5, the iron device 100 may be detachably mounted on the inner side of the cabinet 10. The iron device 100 may include a base wire part 107 and a base wire connector 107*a* arranged at the end of the base wire part 107. The base wire connector 107*a* may be electrically connected to a cabinet wire connector 86*a* arranged at the end of a cabinet wire part 86. The cabinet wire part 86 may be connected to a power part (not shown) to receive power to operate the clothes care apparatus 1. Accordingly, the iron device 100 may receive power for operation from the power part arranged in the cabinet 10. The iron device 100 may include a base 10, and a press plate 110 that may pivot and move with respect to the base 101.

The base 101 may be mounted on the cabinet 10. The base 101 may be supported by the cabinet 10.

There may be a cabinet reinforcing frame 15 arranged in a portion of the cabinet 10 where the iron device 100 is mounted. A base reinforcing frame 102 may be arranged on one side of the base 101 to be mounted on the cabinet 10, to match the cabinet reinforcing frame 15. The cabinet reinforcing frame 15 and the base reinforcing frame 102 may reinforce the strength of the cabinet 10 on which the iron device 100 is mounted.

A cabinet frame hole 15*a* may be formed at the cabinet reinforcing frame 15, and a base frame hole 102*a* may be formed at the base reinforcing frame 102. A fastening member (not shown) may be coupled into the cabinet frame hole 15*a* and base frame hole 102*a*.

The base 101 may include a heat generator 103. The heat generator 103 may be arranged on one side facing the press plate 110 in a position where the press plate 110 covers the base 101. The heat generator 103 is provided to apply heat to the clothes held on the iron device 100. The heat generator 103 may generate heat by receiving power via the cabinet wire part 86 and the base wire part 107. The heat generator 103 may also be called a heating plate.

The heat generator 103 may be formed with a metal substance such as aluminum and/or stainless steel, which is easy to conduct heat. The heat generator 103 may have coated surfaces to prevent damage to the clothes. The heat generator 103 may be formed with an anti-rust material to prevent rust caused by steam. The heat generator 103 may include a plurality of heaters.

A reception groove 104 may be formed on the base 101 to receive part of a first clothes fixing member 141. The reception groove 104 is formed to receive at least part of a first clip 141*a* of the first clothes fixing member 141 when the press plate 110 is moved to the base 101 from the position where the press plate 110 covers the base 101. The press plate 110 may be moved closer to the base 101 due to the reception groove 104, thereby creating sharper creases on the clothes.

A plate fixing member 105 may be arranged on the base 101. The plate fixing member 105 may be arranged to fix an end opposite to the other end of the press plate 110 at which the press plate 110 may be pivotally supported when the press plate 110 is in the position to cover the base 101. The plate fixing member 105 may contact a base fixer 113 of the press plate 110 and may be fixed when the press plate 110 is in the position to cover the base 101. The plate fixing member 105 and the base fixer 113 may be formed to include a magnetic substance. The plate fixing member 105 and the base fixer 113 may be interlocked by magnetic force.

A first press guide 106 may be arranged on the base 101 to guide movement of a rack gear 136 of a press driver 130. The first press guide 106 may be arranged at a side to which the press plate 110 is pivotally coupled. The first press guide 106 may extend in a moving direction of the press plate 110 in a position where the press plate 110 covers the base 101. Although there are two first press guides 106 shown in FIG. 4, there are no limitations on the number of the first press guides 106, and the number of the first press guides 106 may correspond to the number of the press drivers 130 as needed.

A first press guide slit 106*a* may be formed on the first press guide 106. The first press guide slit 106*a* may guide movement of a hinge projection 114 when the press plate 110 is moved toward or away from the base 101 from the position where the press plate 110 covers the base 101. The first press guide slit 106*a* may extend in a moving direction of the press plate 110.

A second press guide 108 may be arranged on the base 101 to guide movement of the plate fixing member 105 and the base fixer 113, which are interlocked in the position where the press plate 110 covers the base 101. The second press guide 108 may extend in a moving direction of the press plate 110.

Referring to FIG. 6, a second press guide slit 108*a* may be formed on the second press guide 108. The second press guide slit 108*a* may guide movement of the base fixer 113 when the press plate 110 is moved toward or away from the base 101 from the position where the press plate 110 covers the base 101. The second press guide slit 108*a* may extend in a moving direction of the press plate 110.

The press plate 110 may be provided to be able to pivot between a first position to cover the base 101 as shown in FIG. 5 and a second position unfolded from the base 101 as shown in FIG. 4. Furthermore, when in the first position, the press plate 110 may be movable to a first direction towards the base 101 and a second direction away from the base 101.

The press plate 110 may include a plate body 111 and a cushion part 112 arranged on one side of the plate body 111. The cushion part 112 may be located on one side directed to the base 101 when the press plate 110 is in the first position. The cushion part 112 may play a role of cushion to relieve shock applied to the clothes from between the press plate 110 and the heat generator 103 while the press plate 110 is pressing the clothes to create creases. The cushion part 112 may be formed to include a soft material.

The press plate 110 may include the base fixer 113 arranged to contact the plate fixing member 105 on the base 101 to be fixed when in the first position. The base fixer 113 may be formed to include a magnetic substance.

The press plate 110 may be pivotally supported on the press driver 130. The press plate 110 may include the hinge projection 114 rotationally coupled to the press driver 130. The hinge projection 114 may be located on a side opposite to the other side where the base fixer 113 is arranged. Although there are two hinge projections 114 shown in FIG. 4, there are no limitations on the number of hinge projections 114.

Figure 7:
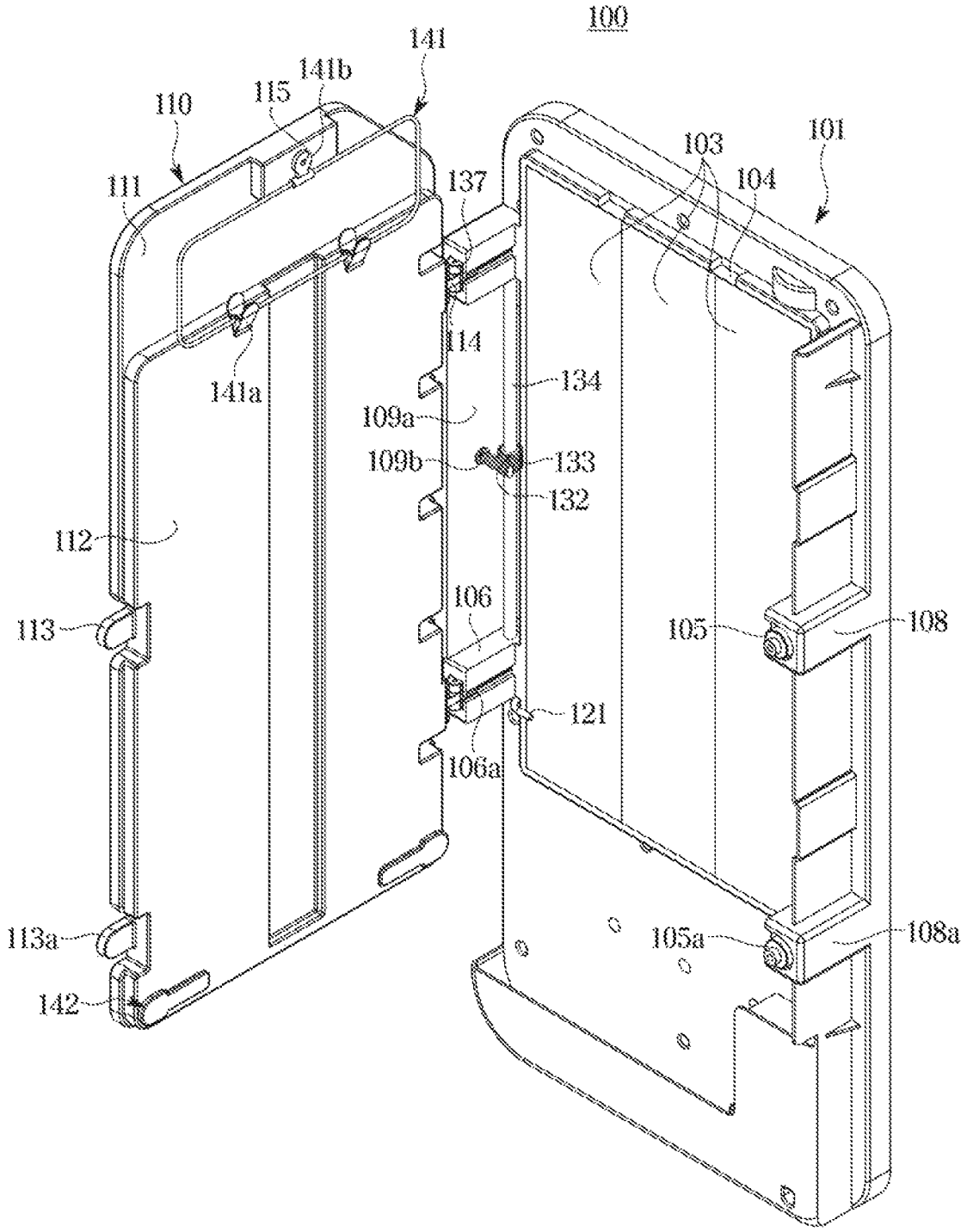
FIG. 7 shows a plate fixing member and a base fixer of the iron device shown in FIG. 4, according to an embodiment of the disclosure.

FIG. 7 shows a plate fixing member and a base fixer of the iron device shown in FIG. 4, according to an embodiment of the disclosure.

Unlike in FIG. 4 where the base fixer 113, the plate fixing member 105, and the second press guide 108 are each provided in the singular, referring to FIG. 7, there may be two for each of the base fixer 113 and 113*a*, the plate fixing member 105 and 105*a*, and the second press guide 108 and 108*b*. The base fixers 113 and 113*a* may include a first base fixer 113 and a second base fixer 113*a*; the plate fixing member 105 and 105*a* may include a first plate fixing member 105 and a second plate fixing member 105*a*; and the second press guides 108 and 108*b* may include a press guide 2*a* 108 and a press guide 2*b* 108*b*. As there are the plurality of base fixers 113 and 113*a*, plate fixing members 105 and 105*a*, and second press guides 108 and 108*b*, the press plate 110 may be moved more stably in the first or second direction.

Referring to FIG. 4, the press plate 110 may include a catch projection 115. The catch projection 115 may protrude from the press body 111 to catch the first clothes fixing member 141. The catch projection 115 may protrude from the side of the press body 111 on which the clothes is held.

Referring to FIG. 4, the iron device 100 may include the first clothes fixing member 141 to fasten an end of the clothes. The first clothes fixing member 141 may be detachably mounted in a top portion of the press plate 110. The first clothes fixing member 141 may be caught by the catch projection 115 of the press plate 110. The first clothes fixing member 141 may include a hook head 141*b* provided to be hooked by the catch projection 115. The hook head 141*b* may include a hole matching the catch projection 115. In a case that the clothes is pants, the first clothes fixing member 141 may fasten the bottom end of the pants.

The first clothes fixing member 141 may include a first clip 141*a* to fasten the clothes. The first clip 141*a* may be provided in the plural. A plurality of first clips 141*a* may be movable to adjust the size of the clothes.

Figure 8:
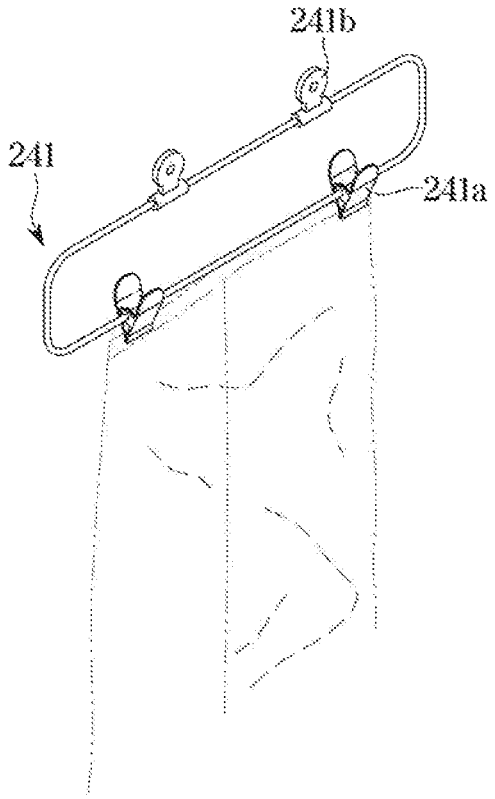
FIG. 8 shows a first clothes fixing member shown in FIG. 4, according to another embodiment of the disclosure.

FIG. 8 shows the first clothes fixing member shown of FIG. 4, according to another embodiment of the disclosure.

Referring to FIG. 8, a first clothes fixing member 241 may include a plurality of hook heads 241*b* unlike the first clothes fixing member 141 shown in FIG. 4. Although not shown, to match the plurality of hook heads 241*b*, there may be a plurality of catch projections 115 arranged on the press plate 110. There may be as many hook heads 241*b* as the number of the catch projections 115.

As shown in FIG. 8, as there are the plurality of hook heads 241*b*, the first clothes fixing member 241 may be coupled to the press plate 110 more stably.

Figure 9:
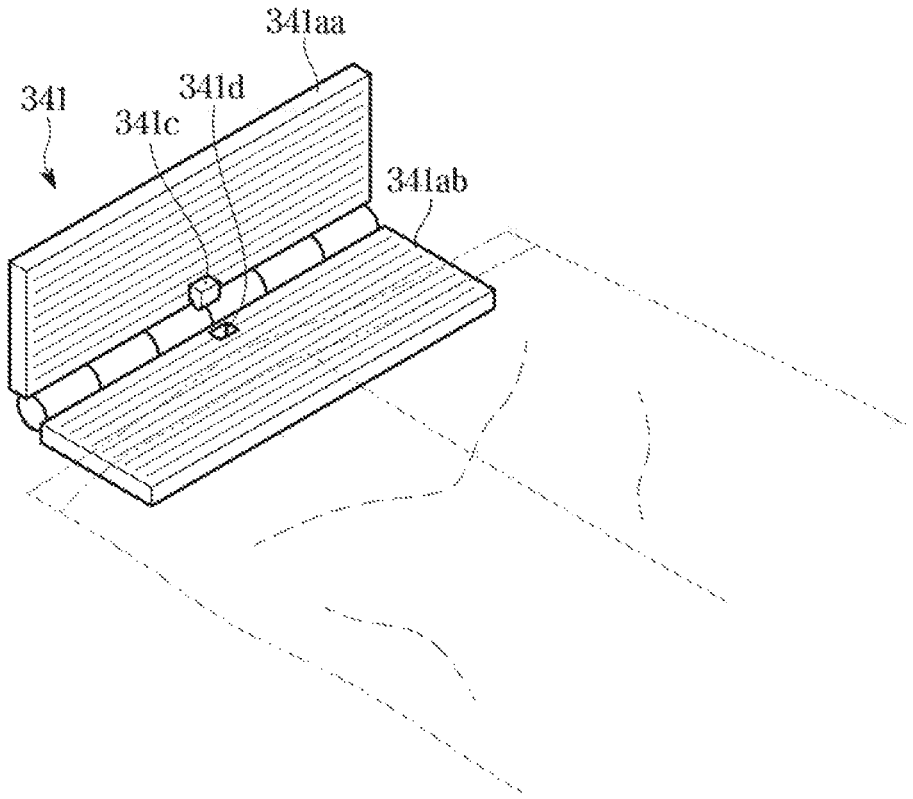
FIG. 9 shows the first clothes fixing member of FIG. 4, according to another embodiment of the disclosure.

FIG. 9 shows the first clothes fixing member of FIG. 4, according to another embodiment of the disclosure.

Referring to FIG. 9, a first clothes fixing member 341 may have a single first clip 341*aa* and 341*ab* unlike the first clothes fixing member 141 shown in FIG. 4, and the first clip 341*aa* and 341*ab* may be larger in size than the first clip 141*a* shown in FIG. 4. Furthermore, the first clip 341*aa* and 341*ab* may include a clip fixing device 341*c* and 341*d*.

Specifically, the first clip 341*aa* and 341*ab* may include a clip 1*a* 341*aa* and clip 1*b* 341*ab*, and a clip fixing projection 341*c* may be arranged on the clip 1*a* 341*aa* and a clip fixing groove 341*d* may be arranged on the clip 1*b* 341*ab*. With this structure, when the first clip 341*aa* and 341*ab* fastens the clothes, the clip fixing projection 341*c* may be inserted to and caught in the clip fixing groove 341*d*, and due to the fixing force of the clip fixing device 341*c* and 341*d*, the first clothes fixing member 341 may fasten and support the clothes more securely. As the clip fixing projection 341*c* is separated from the clip fixing groove 341*d*, the first clothes fixing member 341 may unfasten the clothes. The clip fixing projection 341*c* may be separated from the clip fixing groove 341*d* in a push latch mechanism. However, how the clip fixing projection 341*c* is separated from the clip fixing groove 341*d* is not limited thereto, and there may be various known mechanisms applied thereto.

As compared with the first clothes fixing member 141 shown in FIG. 4, the first clothes fixing member 341 shown in FIG. 9 may be beneficial for the user to manipulate it with one hand.

Referring to FIG. 4, the iron device 100 may include a second clothes fixing member 142 to fix a portion of the clothes. The second clothes fixing member 142 may be movably and/or rotationally mounted on the bottom portion of the press plate 110. The second clothes fixing member 142 may be mounted on either side of the bottom portion of the press plate 110. In a case that the clothes is pants, the second clothes fixing member 142 may fix hip portions of the pants.

The second clothes fixing member 142 may be provided to be rotational between an almost horizontal position to fasten the clothes and an almost vertical position to unfasten the clothes. The user may place the clothes on the cushion part 112 of the press plate 110 while putting the second clothes fixing member 142 in the almost vertical position, and fasten the clothes by rotating the second clothes fixing member 142 into the almost horizontal position.

The second clothes fixing member 142 is provided to be movable to adjust the size of the clothes. The second clothes fixing member 142 may be moved to either side of the press plate 110 to fasten a relatively big sized clothes. The second clothes fixing member 142 may be moved toward the center of the press plate 110 to fasten a relatively small sized clothes.

Figure 10:
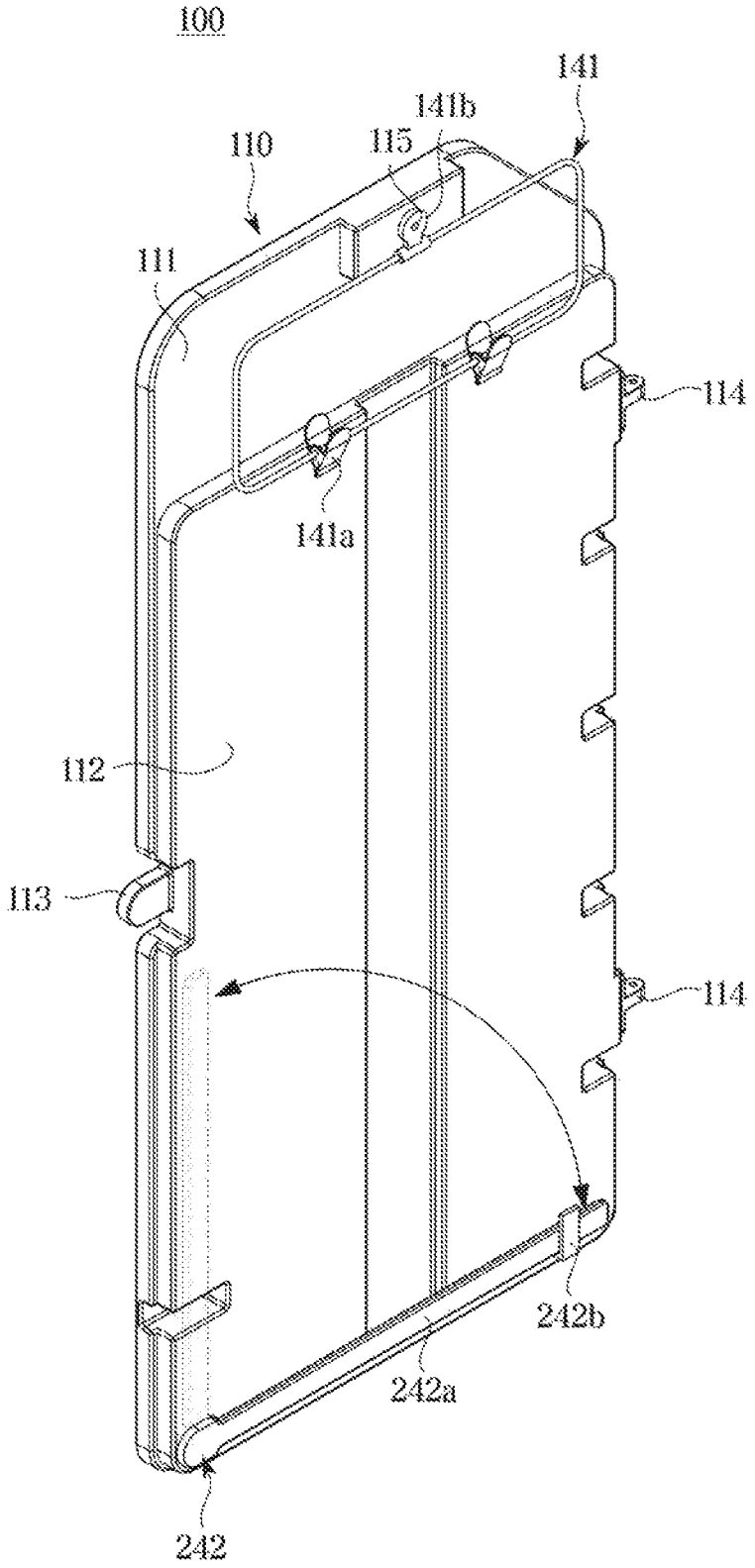
FIG. 10 shows a second clothes fixing member of FIG. 4, according to another embodiment of the disclosure.

FIG. 10 shows the second clothes fixing member of FIG. 4, according to another embodiment of the disclosure.

Referring to FIG. 10, a second clothes fixing member 242 may include a fastening bar 242*a* and a catcher 242*b* unlike the second clothes fixing member 142 shown in FIG. 4.

The fastening bar 242*a* may be pivotally arranged at an end of the bottom portion of the press plate 110. The fastening bar 242*a* may be provided to be rotational between an almost horizontal position to fasten the clothes and an almost vertical position to unfasten the clothes.

The catcher 242*b* may be located on a side of the bottom portion of the press plate opposite to the side to which the fastening bar 242*a* is pivotally coupled. The catcher 242*b* may be arranged to support an end of the fastening bar 242*a* opposite to the other end that corresponds to a pivot axis of the fastening bar 242*a*. The catcher 242*b* may support the fastening bar 242*a* not to further pivot around when the fastening bar 242*a* is in the almost horizontal position to fasten the clothes. The catcher 242*b* may be arranged to limit rotation of the fastening bar 242*a*.

As compared with the second clothes fixing member 142 shown in FIG. 4, the second clothes fixing member 242 shown in FIG. 10 may be beneficial for the user to manipulate it with one hand.

Figure 11:
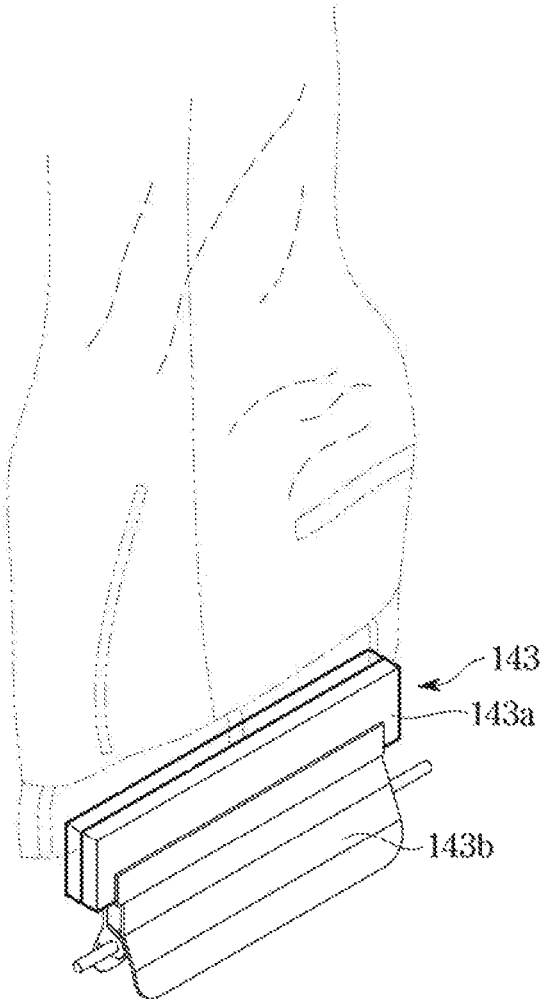
FIG. 11 shows a third clothes fixing member to be equipped in the iron device shown in FIG. 4, according to an embodiment of the disclosure.

FIG. 11 shows a third clothes fixing member to be equipped in the iron device shown in FIG. 4, according to an embodiment of the disclosure.

Referring to FIG. 11, the iron device 100 may include a third clothes fixing member 143 to fix the other end of the clothes opposite to the end fixed by the first clothes fixing member 141. The third clothes fixing member 143 may fix the bottom end of the clothes. In the case that the clothes is pants, the third clothes fixing member 143 may fix a waist portion of the pants.

The third clothes fixing member 143 may include a second clip 143*a* and a lever 143*b*. The third clothes fixing member 143 may be formed for the second clip 143*a* to unfasten the clothes when the lever 143*b* is pressed, and for the second clip 143*a* to fasten the clothes when the lever 143*b* is not pressed. For this, the third clothes fixing member 143 may include an elastic member (not shown) to connect between the second clip 143*a* and the lever 143*b*. The second clip 143*a* and/or the lever 143*b* may be provided to apply certain force to the bottom end of the clothes. The second clip 143*a* and/or the lever 143*b* may also be seen as a forcing member because they may be provided to apply the certain force to the bottom end of the clothes.

Figure 12:
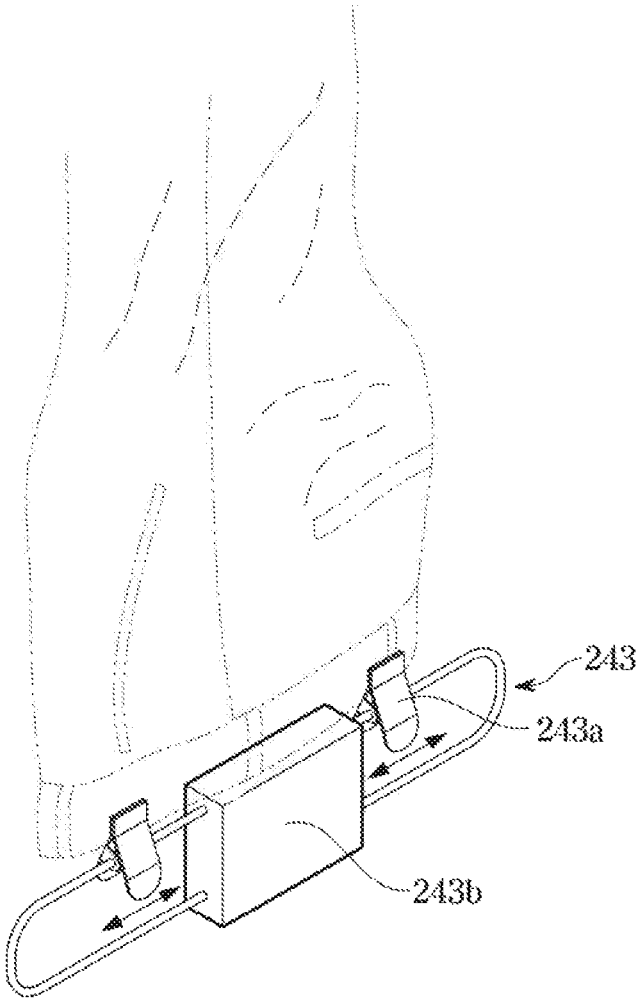
FIG. 12 shows the third clothes fixing member of FIG. 11, according to another embodiment of the disclosure.

FIG. 12 shows the third clothes fixing member of FIG. 11, according to another embodiment of the disclosure.

Referring to FIG. 12, the third clothes fixing member 243 may include a second clip 243*a* and a forcing member 243*b*. There may be a plurality of second clips 243*a* arranged on either side from the forcing member 243*b*. The second clip 243*a* may be movable to adjust the size of the clothes.

The forcing member 243*b* may be provided to apply certain force to the bottom end of the clothes. As the forcing member 243*b* applies certain force to the bottom end of the clothes, wrinkles of the clothes may be removed to certain extent due to the force of the forcing member 243*b* applied while the clothes is hung on the press plate 110.

As described above, the clothes may be stably fixed by the first clothes fixing member 141, 241, and 341, the second clothes fixing member 142 and 242, and the third clothes fixing member 143 and 243.

Turning back to FIG. 4, the iron device 100 may include a steam nozzle 121 arranged on the base 101. The steam nozzle 121 may be provided to inject steam directly into space between the base 101 and the press plate 110 when the press plate 110 is in the position to cover the base 101. The steam nozzle 121 may be arranged to correspond to a lower portion of the heat generator 103 arranged on the base 101. The steam nozzle 121 may be arranged on either side of the lower portion of the heat generator 103. The steam nozzle 121 may be arranged to move up by a certain angle from the lower portion of the heat generator 103. For example, the steam nozzle 121 may be arranged to move up by about 15 degrees from the lower portion of the heat generator 103. The steam injected from the steam nozzle 121 has high temperature, so it moves upward. Accordingly, even when the steam nozzle 121 is located close to the lower portion of the heat generator 103, the steam may be applied evenly to the clothes.

Referring to FIG. 5, the steam nozzle 121 may be coupled to the steam generating device 80. The steam nozzle 121 may receive steam from the steam generating device 80. The steam nozzle 121 may be coupled to a base hose 122 at the base 101, and there is a base hose connector 122*a* arranged at an end of the base hose 122 opposite to the other end of the base hose 122 coupled to the steam nozzle 121. A cabinet hose 85 may extend from the steam generating device 80, and there is a cabinet hose connector 85*a* arranged at an end of the cabinet hose 85 opposite to the other end of the cabinet hose 85 coupled to the steam generating device 80. When the iron device 100 is mounted on the cabinet 10, the base hose connector 122*a* may be coupled to the cabinet hose connector 85*a*. Accordingly, the iron device 100 may receive steam from the steam generating device 80.

Figure 13:
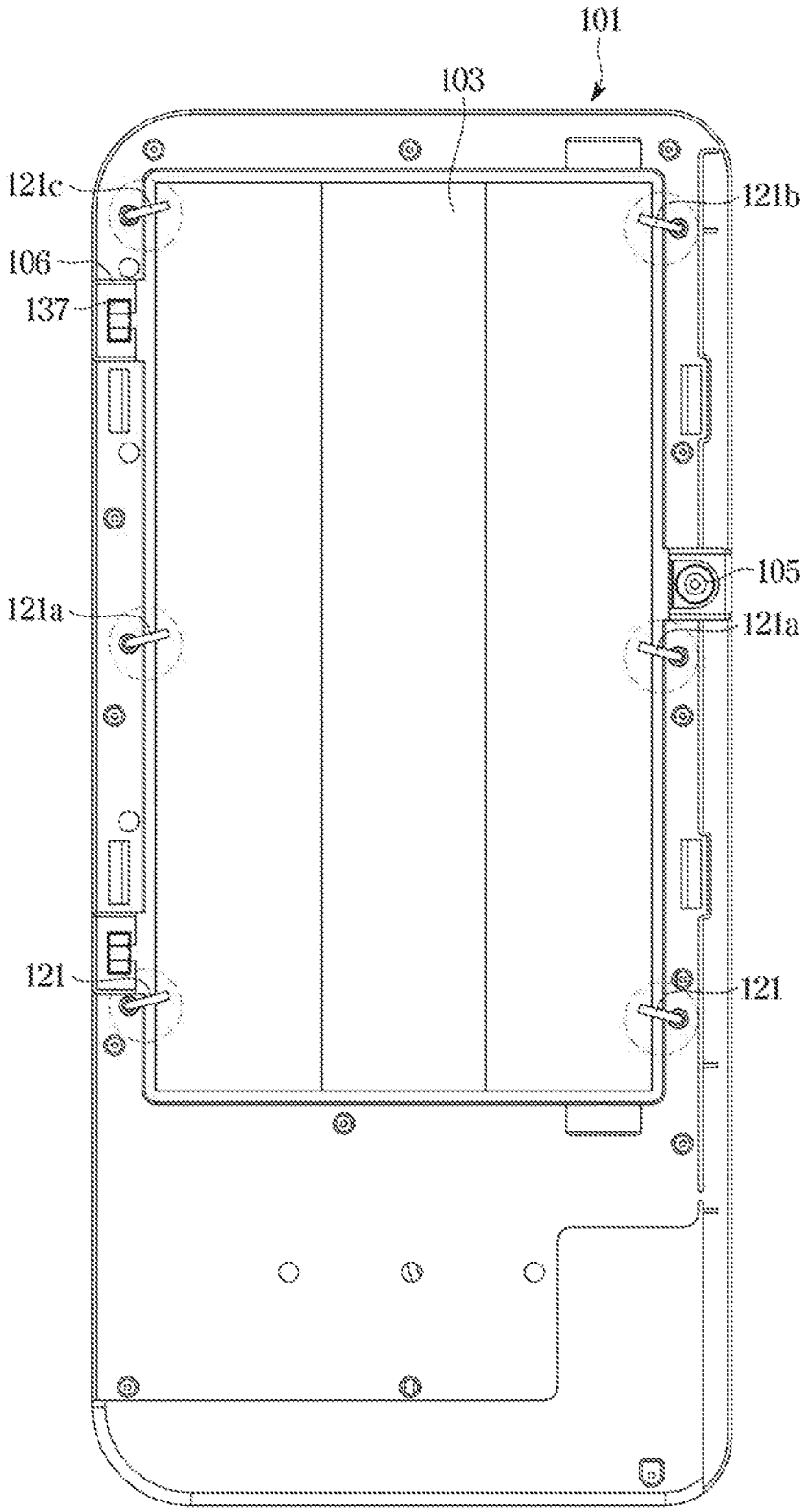
FIG. 13 shows steam nozzles of the iron device shown in FIG. 4, according to another embodiment of the disclosure.

FIG. 13 shows steam nozzles of the iron device shown in FIG. 4, according to another embodiment of the disclosure.

Referring to FIG. 13, steam nozzles 121, 121*a*, and 121*b* may include a first steam nozzle 121 located to correspond to the lower portion of the heat generator 103, as shown in FIG. 4, a second steam nozzle 121*a* located to correspond to an almost center portion of the heat generator 103, and a third steam nozzle 121*b* located to correspond to an upper portion of the heat generator 103. The first, second, and third steam nozzles 121, 121*a*, and 121*b* may be arranged to move up by about 15 degrees.

The steam nozzles 121, 121*a*, and 121*b* shown in FIG. 13 may supply steam more evenly to the clothes than the steam nozzle 121 shown in FIG. 4. That is, the steam nozzles 121, 121*a*, and 121*b* of FIG. 13 may prevent the steam from being supplied relatively little to the upper portion of the clothes.

Figure 14:
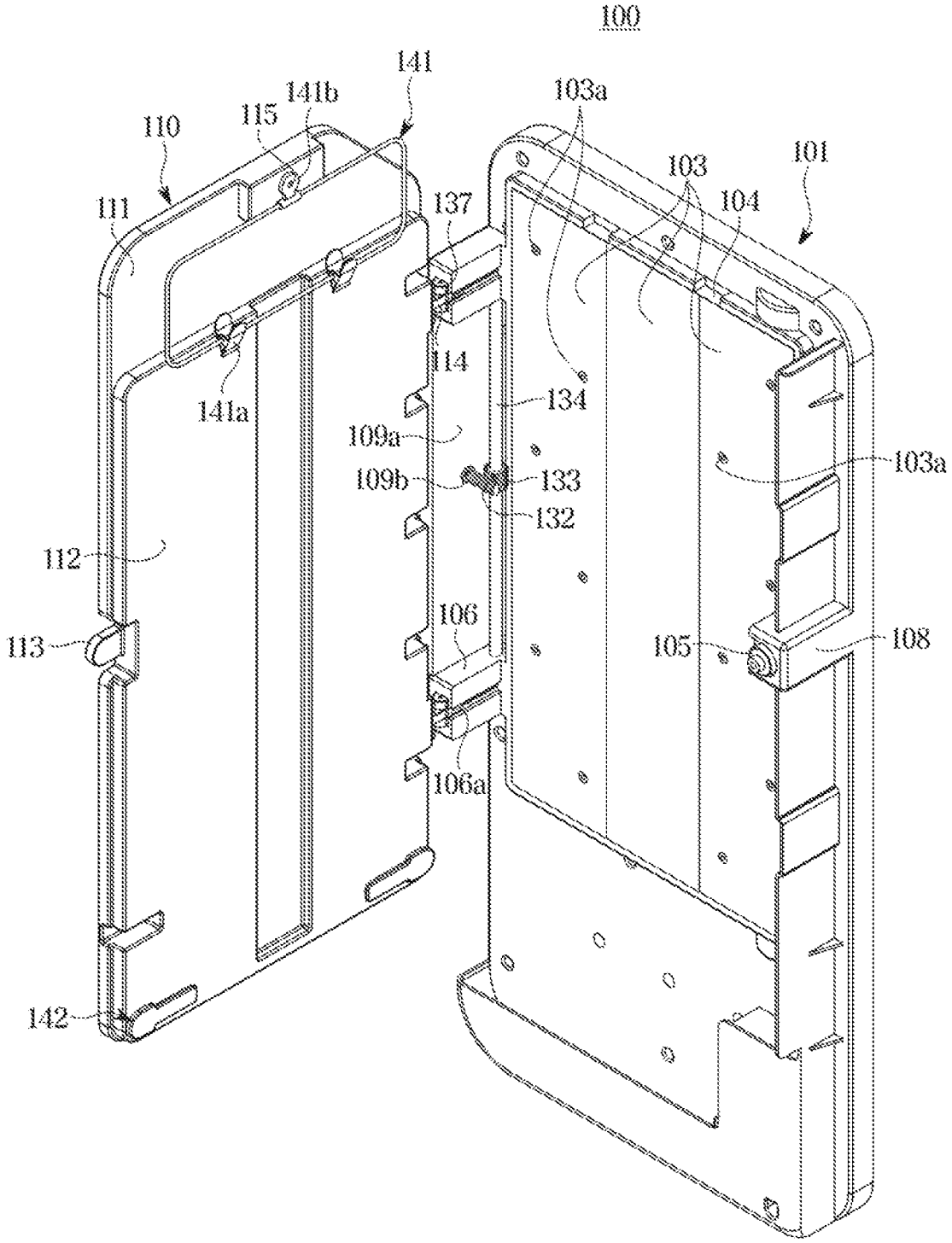
FIG. 14 shows steam nozzles of the iron device shown in FIG. 4, according to another embodiment of the disclosure.

FIG. 14 shows steam nozzles of the iron device shown in FIG. 4, according to another embodiment of the disclosure.

Referring to FIG. 14, the iron device 100 may include steam nozzles 103*a* each provided in the form of a steam injection hole penetrating the heat generator 103. The steam nozzle 103*a* may be coupled to the base hose 122 inside the base 101 to receive steam.

In FIG. 14, the iron device 100 may supply steam to space between the press plate 110 and the base 101 through the steam nozzles 103*a* when the press plate 110 is in the first position.

Figure 15:
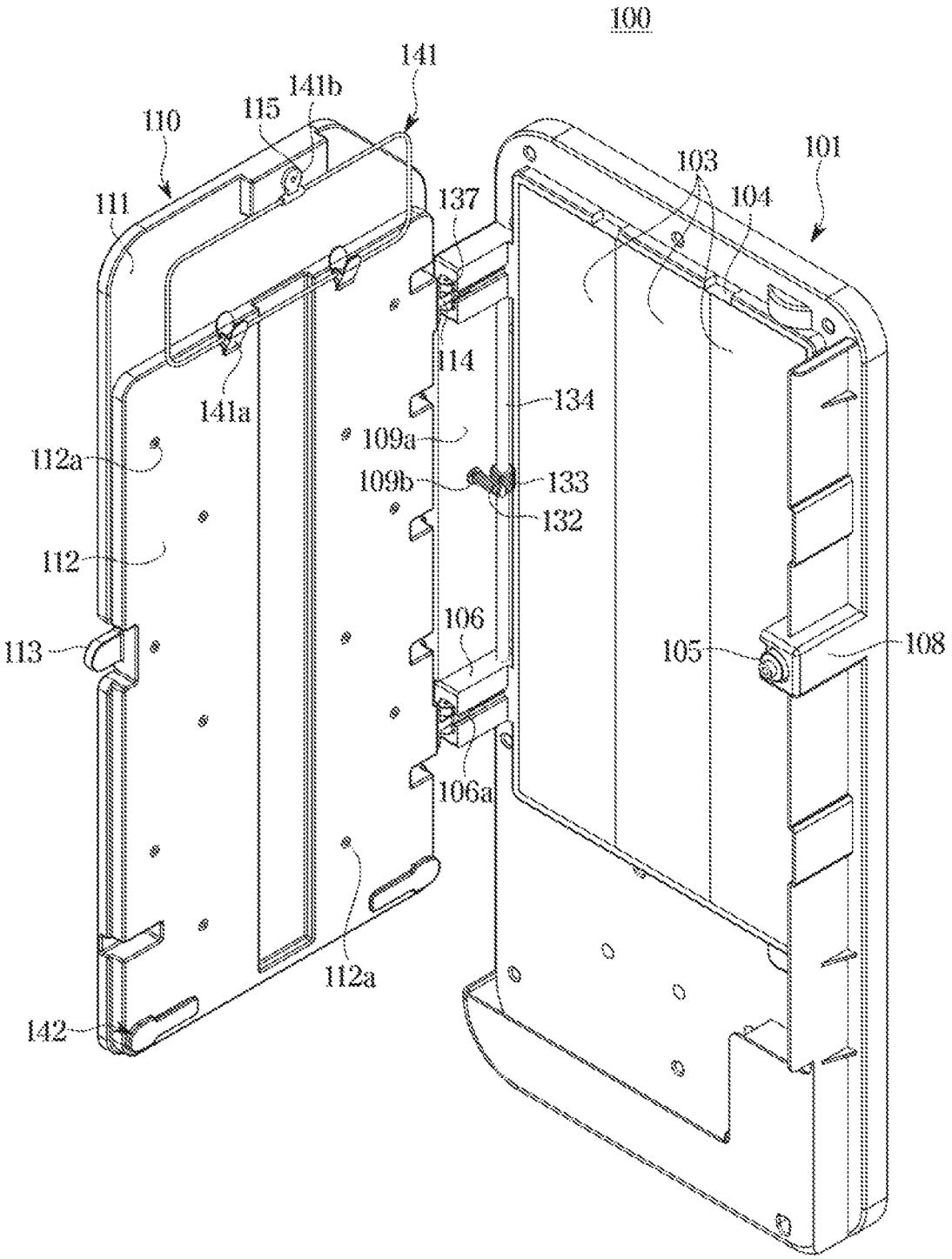
FIG. 15 shows steam nozzles of the iron device shown in FIG. 4, according to another embodiment of the disclosure.

FIG. 15 shows steam nozzles of the iron device shown in FIG. 4, according to another embodiment of the disclosure.

Referring to FIG. 15, the iron device 100 may include steam nozzles 112*a* each provided in the form of a steam injection hole penetrating the cushion part 112. The steam nozzle 112*a* may be coupled to the base hose 122 extending to the press plate 110 through the press hinge 137 and the hinge projection 114. Accordingly, the steam nozzle 112*a* may receive steam.

In FIG. 15, the iron device 100 may supply steam to the space between the press plate 110 and the base 101 through the steam nozzles 112*a* when the press plate 110 is in the first position.

Turning back to FIGS. 4 and 6, the press driver 130 may support for the press plate 110 to pivot around, and may be arranged to move the press plate 110 in the first direction toward the base 101 and second direction away from the base 101 when the press plate 110 is in the first position. Specifically, the press driver 130 may include a driving source 131, a first gear 132 to receive power from the driving source 131, a second gear 133 interlocked with the first gear 132, a shaft 134 extending along the rotation axis of the second gear 133, a pinion gear 135 arranged at an end of the shaft 134, a rack gear 136 interlocked with the pinion gear 135, and a press hinge 137 arranged at an end of the rack gear 136.

The driving source 131 may be mounted on the base 101. A driving source installation part 109 may be provided at the base 101 to fix the driving source 131. The driving source installation part 109 may be located on one side of the base 101. The driving source installation part 109 may include a driving source cover 109*a* for covering the space across the first press guide 106 when the press plate 110 is in the second position unfolded from the base 101. The driving source cover 109*a* may include a gear opening 109*b* formed for the first gear 132 to pass through.

The driving source 131 may include a motor enabling forward and reverse rotation. The driving source 131 may receive power via the cabinet wire part 86 and the base wire part 107.

The first gear 132 may be rotated by the power received from the driving source 131. The first gear 132 may be arranged such that its rotation axis is perpendicular to the rotational axis of the second gear 133. As the first gear 132 is rotated by the driving source 131, the second gear 133 is rotated.

The shaft 134 may extend along the rotation axis of the second gear 133. The shaft 134 may extend to either side from the second gear 133. The pinion gear 135 may be arranged at either end of the shaft 134. As the second gear 133 is rotated, the shaft 134 is rotated, and as the shaft is rotated, the pinion gear 135 is rotated.

The rack gear 136 may receive power from the pinion gear 135. As the pinion gear 135 is rotated, the rack gear 136 may be moved linearly. As the pinion gear 135 is rotated, the rack gear 136 may move the press plate 110 to the first or second direction.

The rack gear 135 may extend in the same direction as the first press guide 106. Movement of the rack gear 135 may be guided by the first press guide 106. The rack gear 135 may be linearly moved within the first press guide 106.

The press hinge 137 may be arranged at an end of the rack gear 136 directed to the press plate 110. The press hinge 137 may pivotally support the press plate 110. The press hinge 137 may be rotationally coupled with the hinge projection 114.

When the press plate 110 is moved to the first or second direction by the press driver 130, the plate fixing member 105 of the press plate 110 fixed to the base fixer 113 may be moved to the first or second direction along with the press plate 110. When the press plate 110 is moved to the first or second direction, the plate fixing member 105 may be moved along with the press plate 110 while fixed to the base fixer 113. The plate fixing member 105 may be slidingly inserted to the second press guide 108 arranged on the base 101.

Specifically, one side of the press plate 110 coupled to the press driver 130 may be moved to the first or second direction by the press driver 130, and the other side opposite to the one side is moved with the one side. For this, there may be a structure to selectively limit the rotation of the press plate 110 such that the press plate 110 may be rotated only when more than certain force is applied to the hinge projector 114 of the press plate 110 and the press hinge 137 of the press driver 130 while the press plate 110 is in the first position to cover the base 101. For the structure to selectively limit the rotation of the press plate 110, a projection and a groove may be employed. With this structure, when more than certain force is applied to the press plate 110, the press plate 110 may be rotated with respect to the base 101, and when the press plate 110 is moved to the first or second direction while in the first position, the press plate 110 may be prevented from being rotated so that even a portion where the base fixer 113 is located may be moved along to the first or second direction.

With the structure of the press driver 130, the press plate 10 may be moved to the first or second direction with respect to the base 101, and in particular when the press plate 10 is moving closer to the base 101, the clothes between the press plate 110 and the base 101 may be more efficiently ironed.

The structure of the press driver 130 is not, however, limited thereto, and any structure that enables the press plate 110 to be moved to the first or second direction may be employed.

Figure 16:
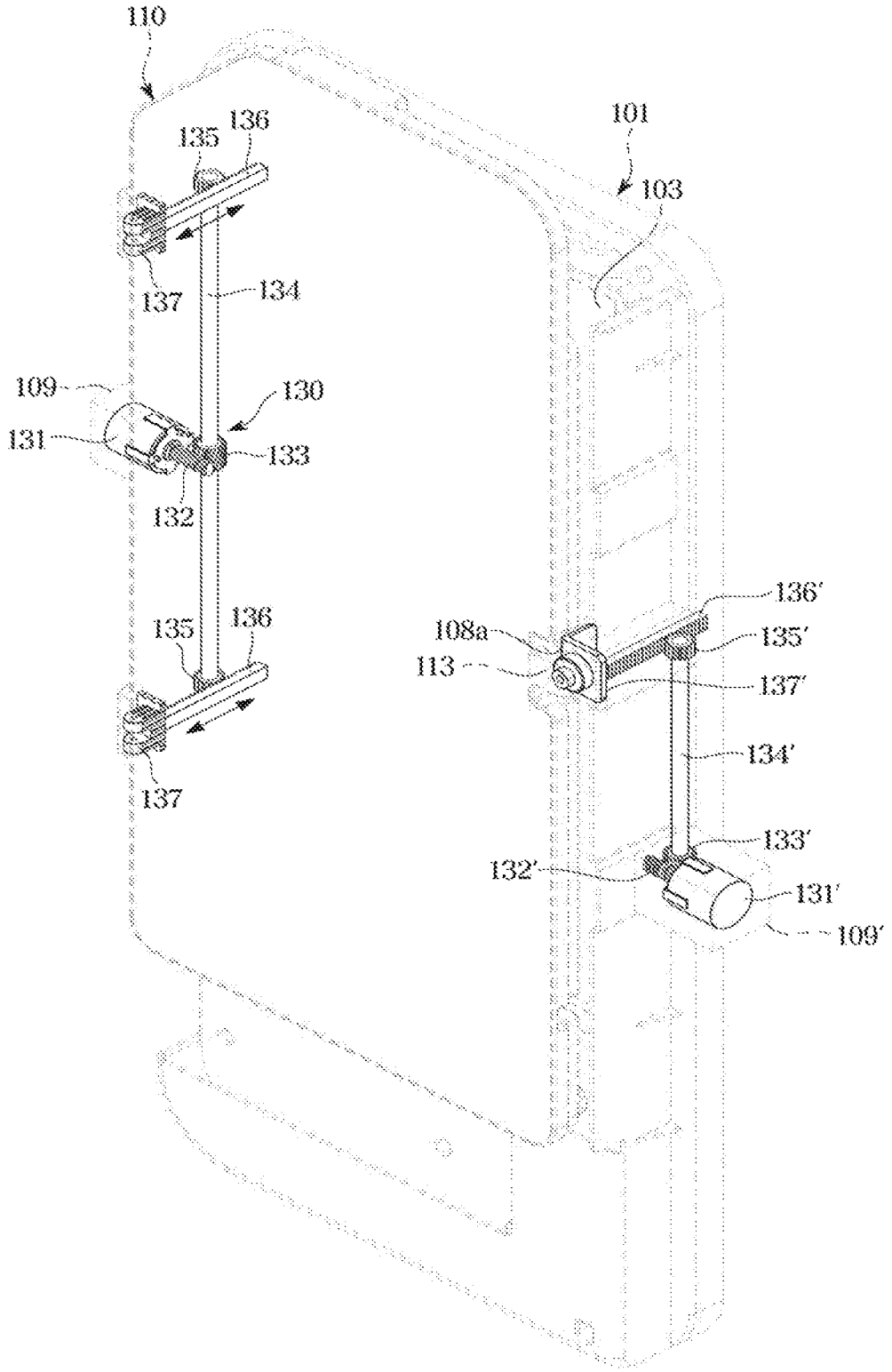
FIG. 16 shows the press driver of FIG. 6, according to another embodiment of the disclosure.

FIG. 16 is the press driver 130 and 130' shown in FIG. 6, according to another embodiment of the disclosure.

Referring to FIG. 16, the press driver 130 and 130' may include a first press driver 130 and a second press driver 130'. The first press driver 130 may have the same structure as in FIG. 6. For this, the base 101 may include the first driving source installation part 109 in which the driving source 131 of the first press driver 130 is installed.

The iron device 100 may include a second press driver 130' provided to support a side of the press plate 110 opposite to the other side of the press plate 110 supported by the first press driver 130, when the press plate 110 is in the first position. when the first press driver 130 moves the press plate 110 to the first or second direction, the second press driver 130' may move the press plate 110 to the first or second direction with the first press driver 130. Like the first press driver 130, the second press driver 130' may include a driving source 131', a first gear 132', a second gear 133', a shaft 134', a pinion gear 135', and a rack gear 136'. Although the pinion gear 135' of the second press driver 130' is shown to be provided in the singular in FIG. 16 unlike the pinion gear 135 of the first press driver 130, it may be provided in the plural.

The second press driver 130' may include a plate fixing member 137' arranged at an end of the rack gear 136' rather than the press hinge 137 of the first press driver 130. The plate fixing member 137' may be detachably fixed to the base fixer 113 of the press plate 110. Like the plate fixing member 105 shown in FIG. 6, the plate fixing member 137' of the second press driver 130' may be formed to include a magnetic sub stance.

The base 101 may include a second driving source installation part 109' in which the driving source 131' of the second press driver 130' is fastened. The second driving source installation part 109' may be located on a side opposite to the other side where the first driving source installation part 109 is located.

The iron device 100 includes the second press driver 130' for supporting movement of an end opposite to the other end of the press plate 110, the movement of which is supported by the first press driver 130, so that the press plate 110 may be moved to/from the base 101 more stably.

Figure 17:
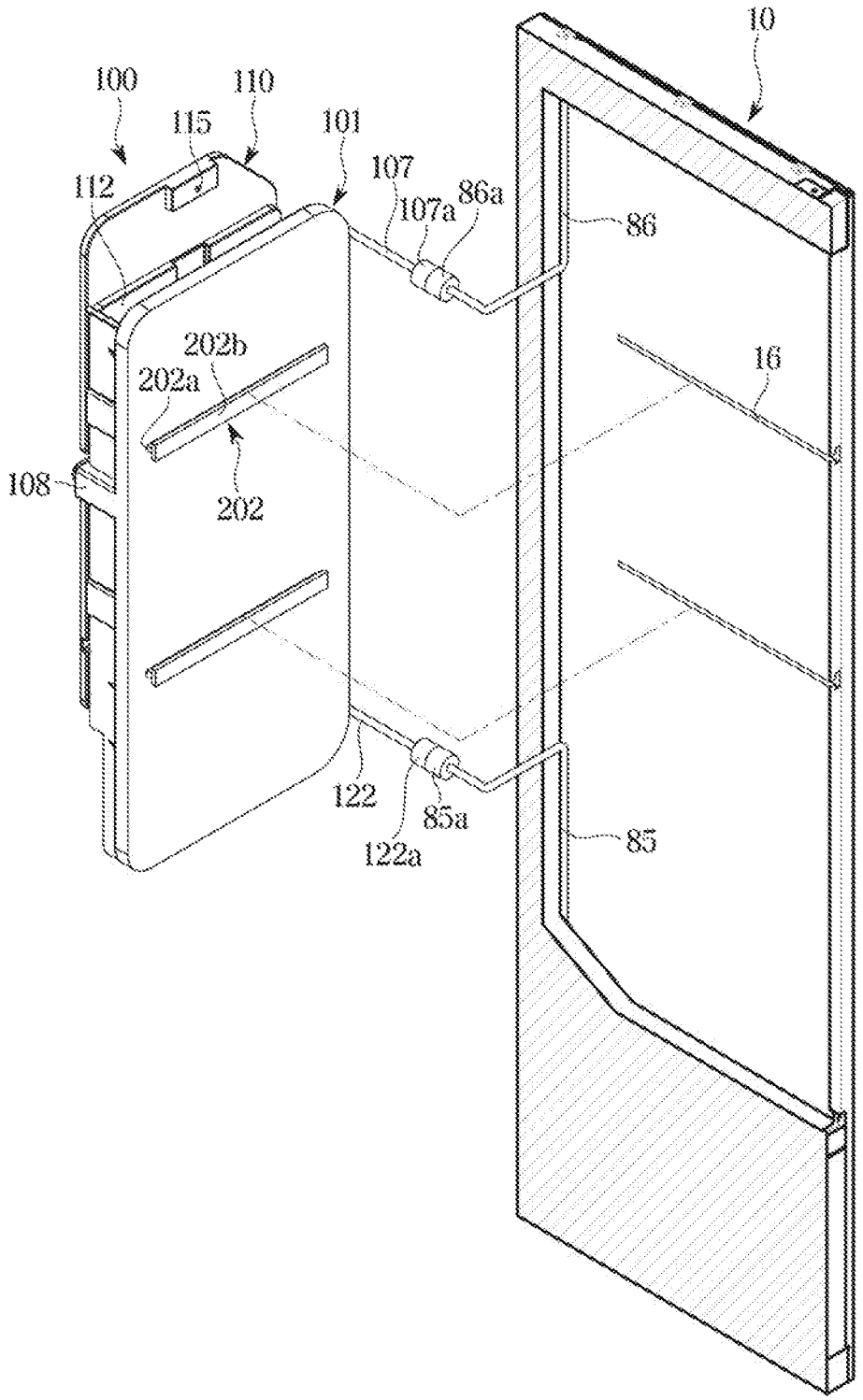
FIG. 17 shows combining of the iron device with the cabinet shown in FIG. 5, according to another embodiment of the disclosure.
Figure 18:
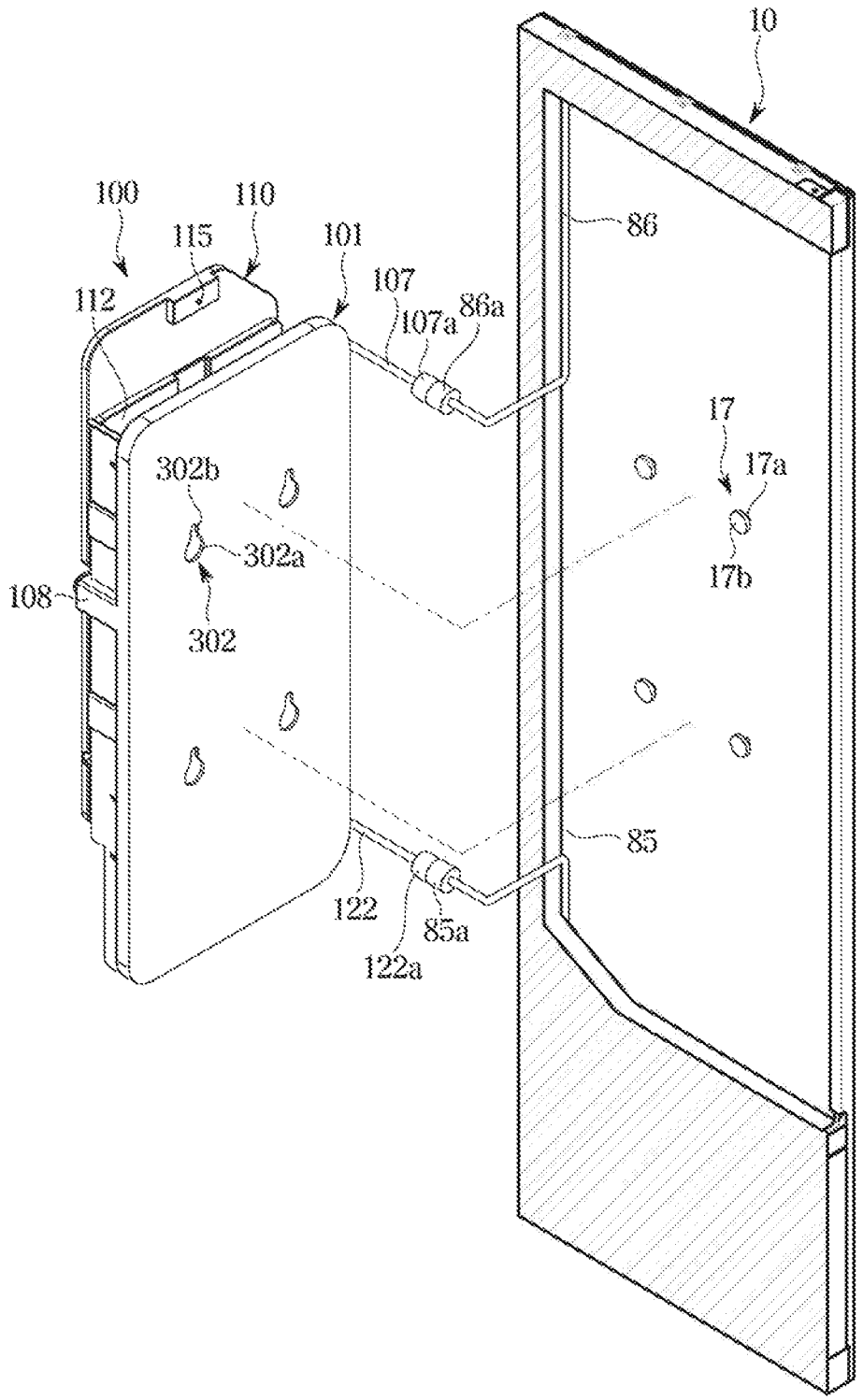
FIG. 18 shows combining of the iron device with the cabinet shown in FIG. 5, according to another embodiment of the disclosure.
Figure 19:
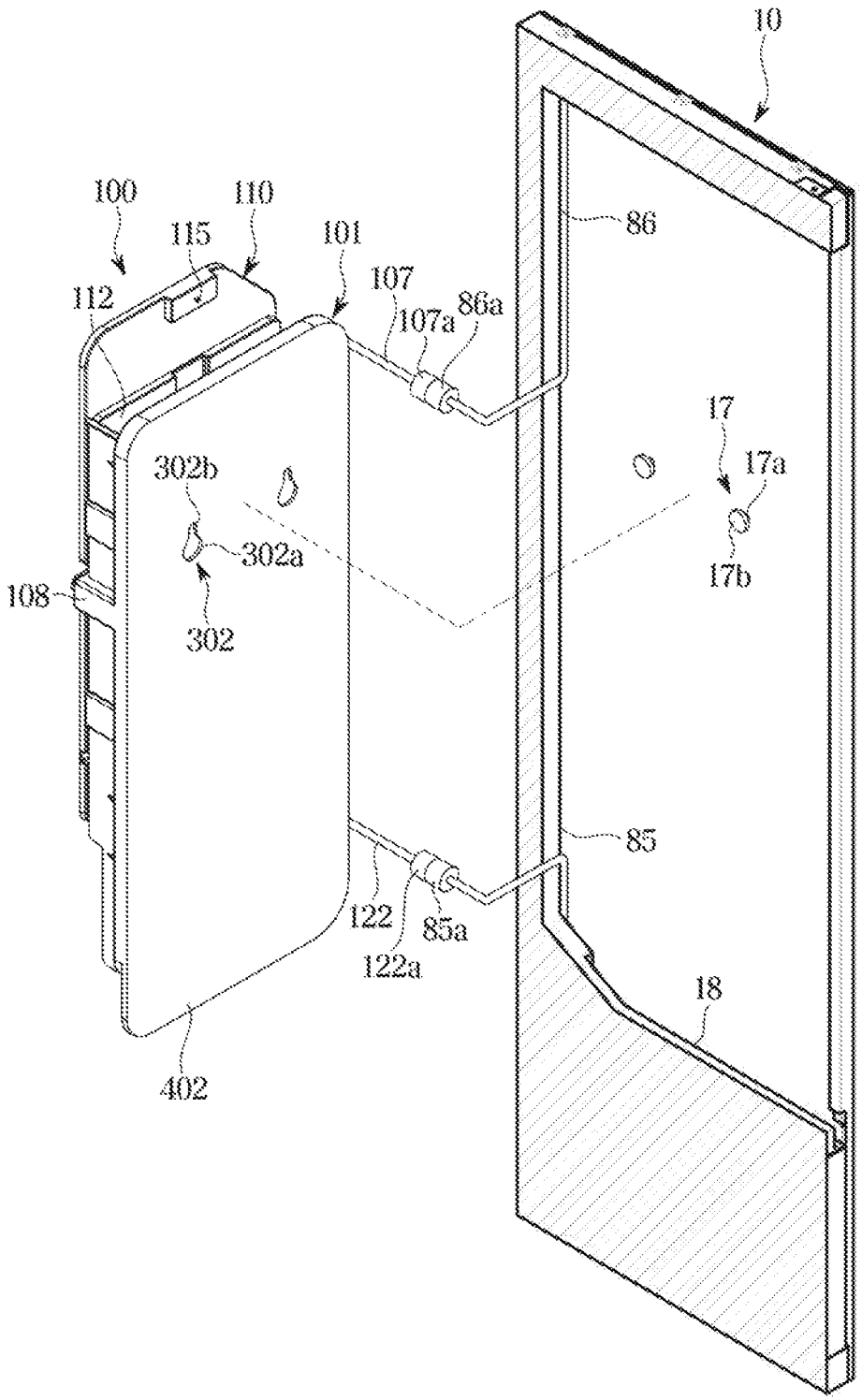
FIG. 19 shows combining of the iron device with the cabinet shown in FIG. 5, according to another embodiment of the disclosure.

FIG. 17 shows combining of the iron device with the cabinet shown in FIG. 5, according to another embodiment of the disclosure. FIG. 18 shows combining of the iron device with the cabinet shown in FIG. 5, according to another embodiment of the disclosure. FIG. 19 shows combining of the iron device shown in FIG. 5 with the cabinet, according to another embodiment of the disclosure.

Referring to FIG. 17, the iron device 100 may include an installation projection 202 formed on a side to be installed on the cabinet 10, and the cabinet 10 may include an installation groove 16 formed on a portion where the iron device 100 is installed.

The installation projection 202 may include a first part **202*a* protruding from a side of the base 101 and a second part 202*b* extending almost vertically from the protruding end of the first part 202*a*. The installation groove 16 may have a form that matches the installation projection 202. When the iron device 100 is installed on the cabinet 10, the installation projection 202 may be slidingly inserted to the installation groove 16**.

With this structure, the iron device 10 may be coupled to the cabinet 10 to be installed on the cabinet 10 in a rather simple way. Furthermore, although two for each of the installation projection 202 and the installation groove 16 are shown in FIG. 17, the number of the installation projections 202 or the installation grooves 16 is not limited thereto.

Referring to FIG. 18, the iron device 100 may include an installation hole 302 formed on a side to be installed on the cabinet 10, and the cabinet 10 may include an installation projection 17 formed on a portion where the iron device 100 is installed.

The installation projection 17 may include a first part **17*a* protruding from an inner side of the cabinet 10 and a second part 17***b* extending almost vertically from the protruding end of the first part 17*a*. The second part 17*b* may have a bigger size than the first part 17*a*.

The installation hole 302 may include an insertion hole 302*a* formed to correspond to the second part 17*b* of the installation projection 17, and a fastening hole 302*b* formed to correspond to the first part 17*a* of the installation projection 17. The installation hole 302 may be formed such that the insertion hole 302*a* has a bigger size than the fastening hole 302*b*, to match the installation projection 17.

When the iron device 100 is installed on the cabinet 10, the installation projection 17 may first be inserted to the insertion hole 302*a* of the installation hole 302. Subsequently, when the iron device 100 falls by gravity by certain height, the first part 17*a* of the installation projection 17 may be slidingly inserted to the fastening hole 302*b* of the installation hole 302. Accordingly, the second part 17*b* of the installation projection 17 may be secured not to fall out of the base 101 when in a state of being inserted to the base 101. As the second part 17*b* is fastened to the base 101, the iron device 100 may be fixedly installed on the cabinet 10.

With this structure, the iron device 10 may be coupled to the cabinet 10 to be installed on the cabinet 10 in a rather simple way. Furthermore, although four for each of the installation projection 17 and the installation groove 302 are shown in FIG. 18, the number of the installation projections 17 or the installation grooves 302 is not limited thereto.

Referring to FIG. 19, the iron device 100 may include the installation hole 302 and an insertion part 402 formed on a side to be installed on the cabinet 10, and the cabinet 10 may include an installation projection 17 and an insertion groove 18 formed on a side where the iron device 100 is installed. The installation hole 302 of the iron device 100 and the installation projection 17 of the cabinet 10 have the same structure as in FIG. 18, so the detailed description thereof will not be repeated.

Unlike what is shown in FIG. 18, in the embodiment of FIG. 19, there may be two for each of the installation hole 302 of the iron device 100 and the installation projection 17 of the cabinet 10, and there may be the insertion part 402 arranged on the iron device 100 and the insertion groove 18 formed on the cabinet 10.

When the iron projection 17 is mounted in the installation hole 302, the insertion part 402 may be fastened by being inserted to the insertion groove 18. Specifically, when the iron device 100 falls after the second part 17*b* of the installation projection 17 is inserted to the insertion hole 302*a*, the insertion part 402 of the iron device 100 may be inserted to the insertion groove 18 of the cabinet 10. In the embodiment of the disclosure in FIG. 19, when the iron device 100 is installed on the cabinet 10, it may be fastened by not only the installation projection 17 and the installation hole 302 but also the insertion part 402 and the insertion groove 18, so the iron device 100 may be coupled with the cabinet 10 more securely.

FIGS. 20 to 24 show a procedure in which the press plate of the iron device shown in FIG. 4 is driven, according to an embodiment of the disclosure.

Referring to FIGS. 20 to 24, a procedure of driving the press plate of the iron device shown in FIG. 4 will be described.

Figure 20:
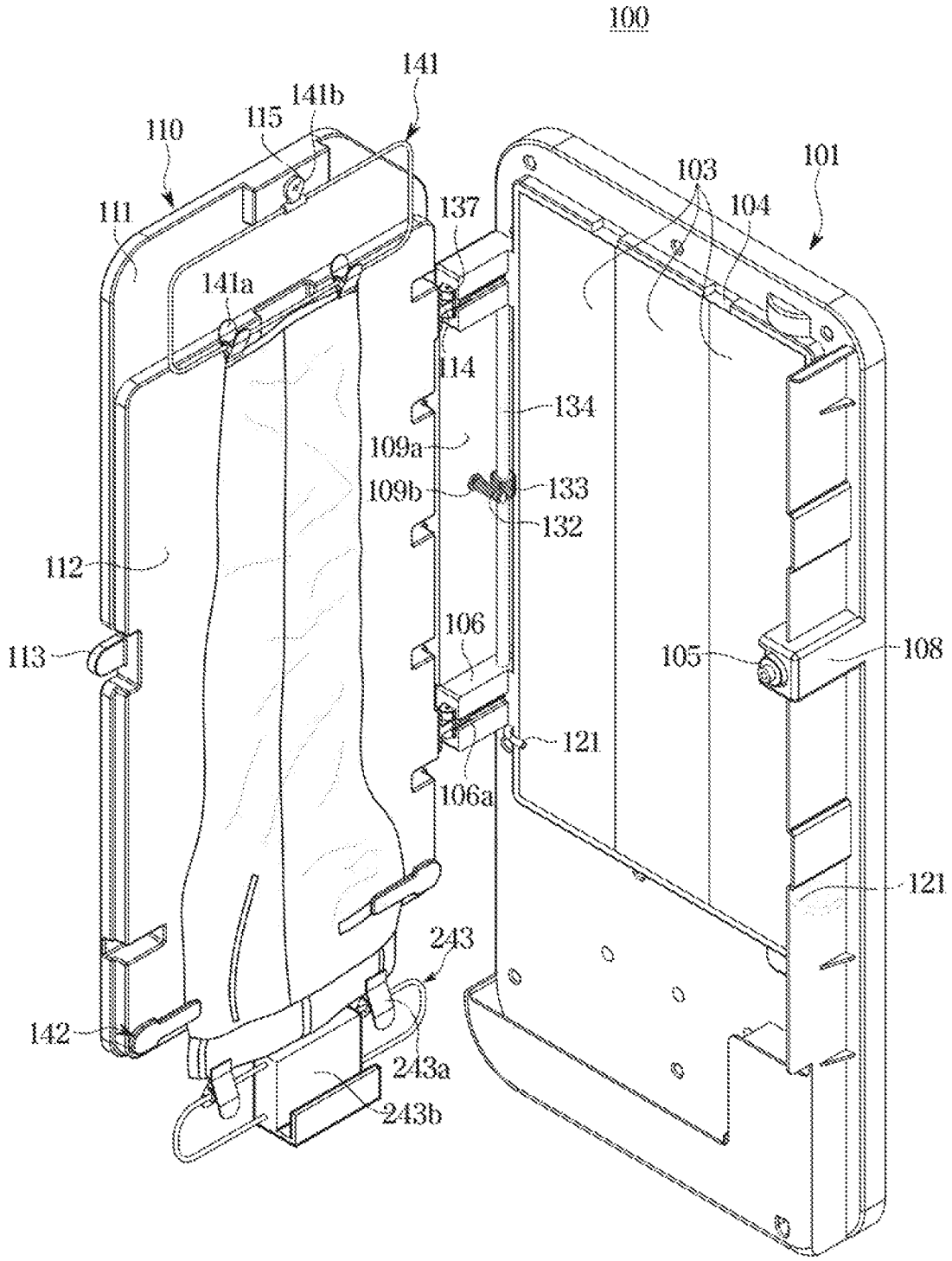
FIGS. 20 to 24 show a procedure in which the press plate of the iron device shown in FIG. 4 is driven, according to an embodiment of the disclosure.

Referring to FIG. 20, when the user tries to create creases on the clothes or remove wrinkles from the clothes, the clothes may be fixed to the first, second, and third clothes fixing members 141, 142, and 143. The clothes may be held on the press plate 110 by the first and second clothes fixing members 141 and 142. The clothes may be pants. To hold the clothes, the press plate 110 may be in the second position unfolded from the base 101.

Figure 21:
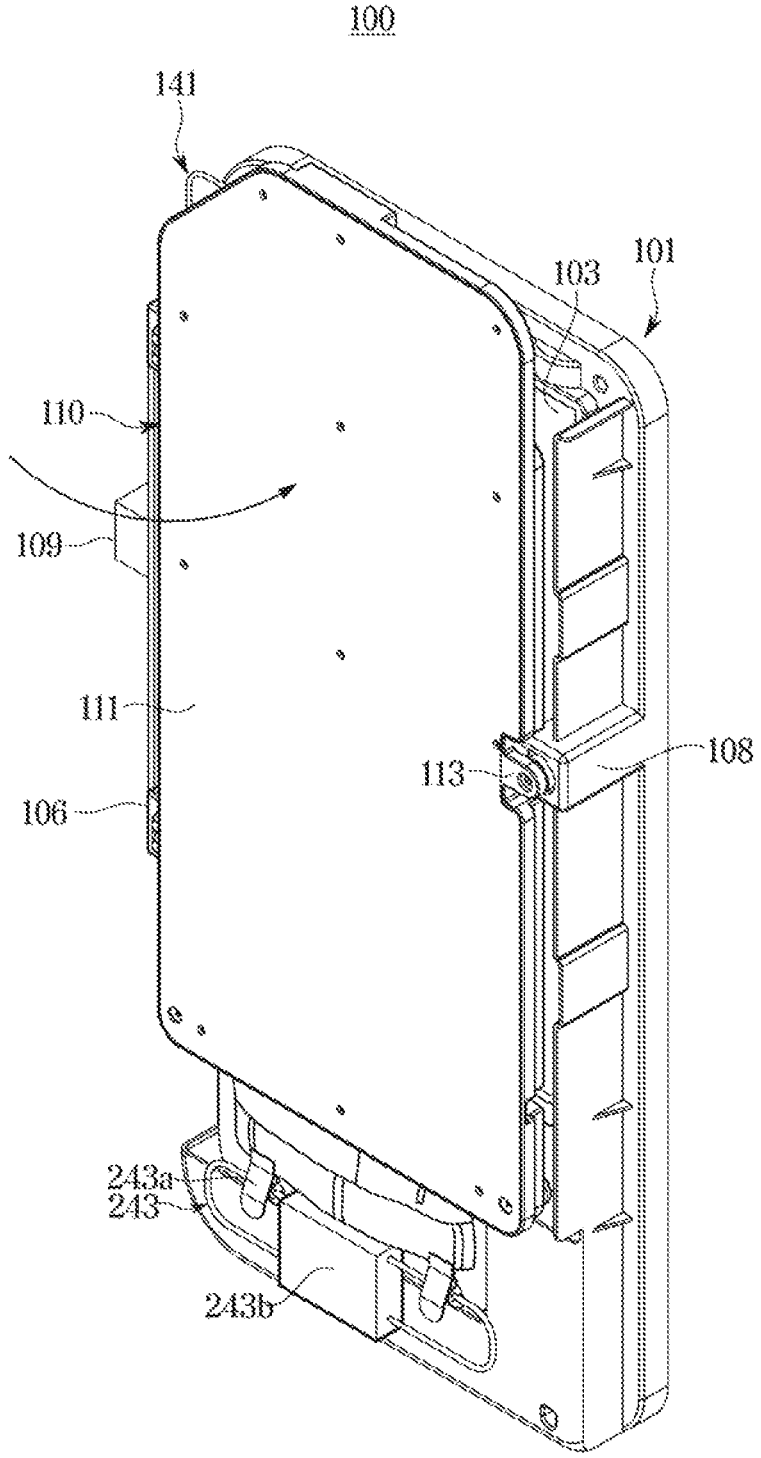

Referring to FIG. 21, after having the clothes held on the press plate 110, the user may pivot the press plate 110 to the first position. When the press plate 110 is in the first position, the base fixer 113 may be fastened to the plate fixing member 105. When in the first position, the press plate 110 may be arranged a certain distance away from the base 101. The steam nozzle 121 may supply steam to the space between the press plate 110 and the base 101, when the press plate 110 is in the first position.

Figure 22:
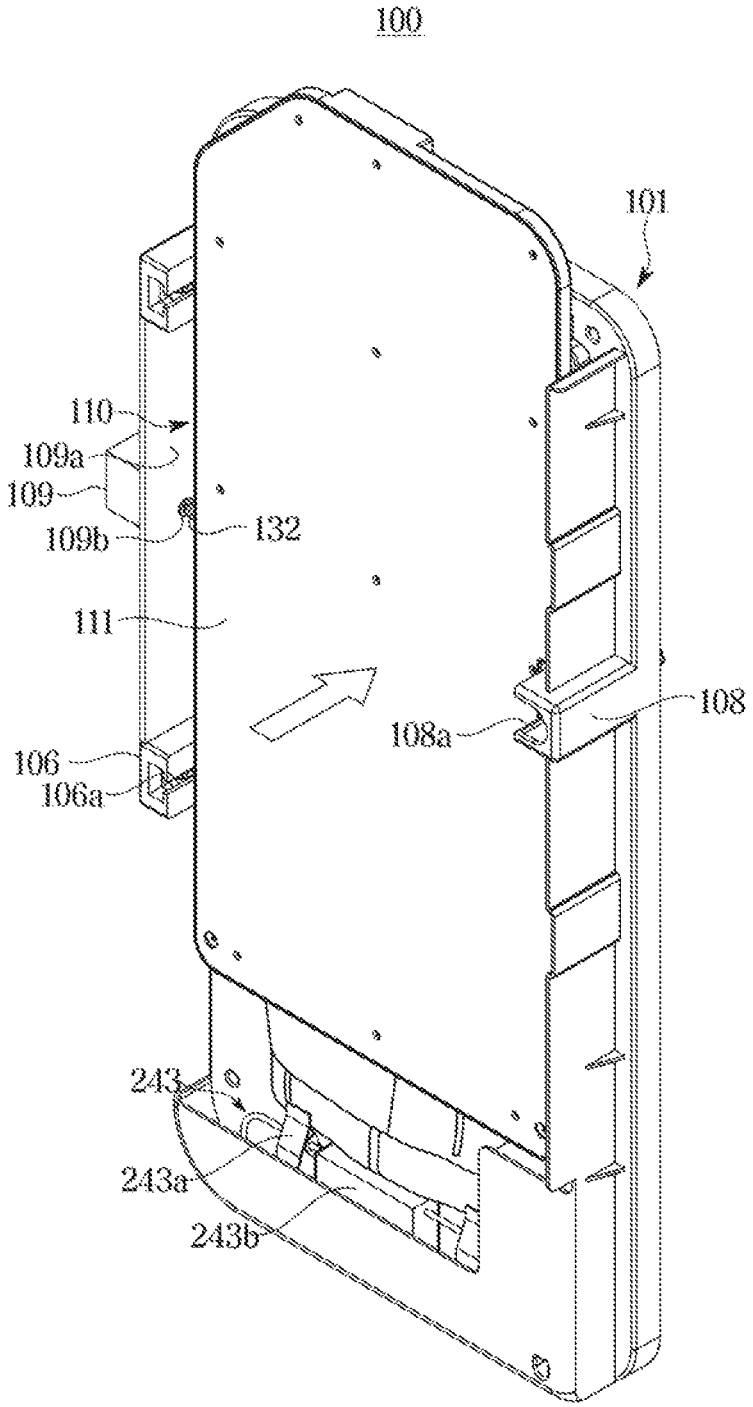

Referring to FIG. 22, when the supplying steam to the space between the press plate 110 and the base 101 is completed, the press plate 110 may be moved toward the base 101. As the press plate 110 is moved toward the base 101, the clothes located between the press plate 110 and the base 101 may be pressed. Because the clothes is in a steamed state, the clothes pressed by the press plate 110 and the base 101 may be creased more sharply while being dried by the heat generator 103 of the base 101.

Figure 23:
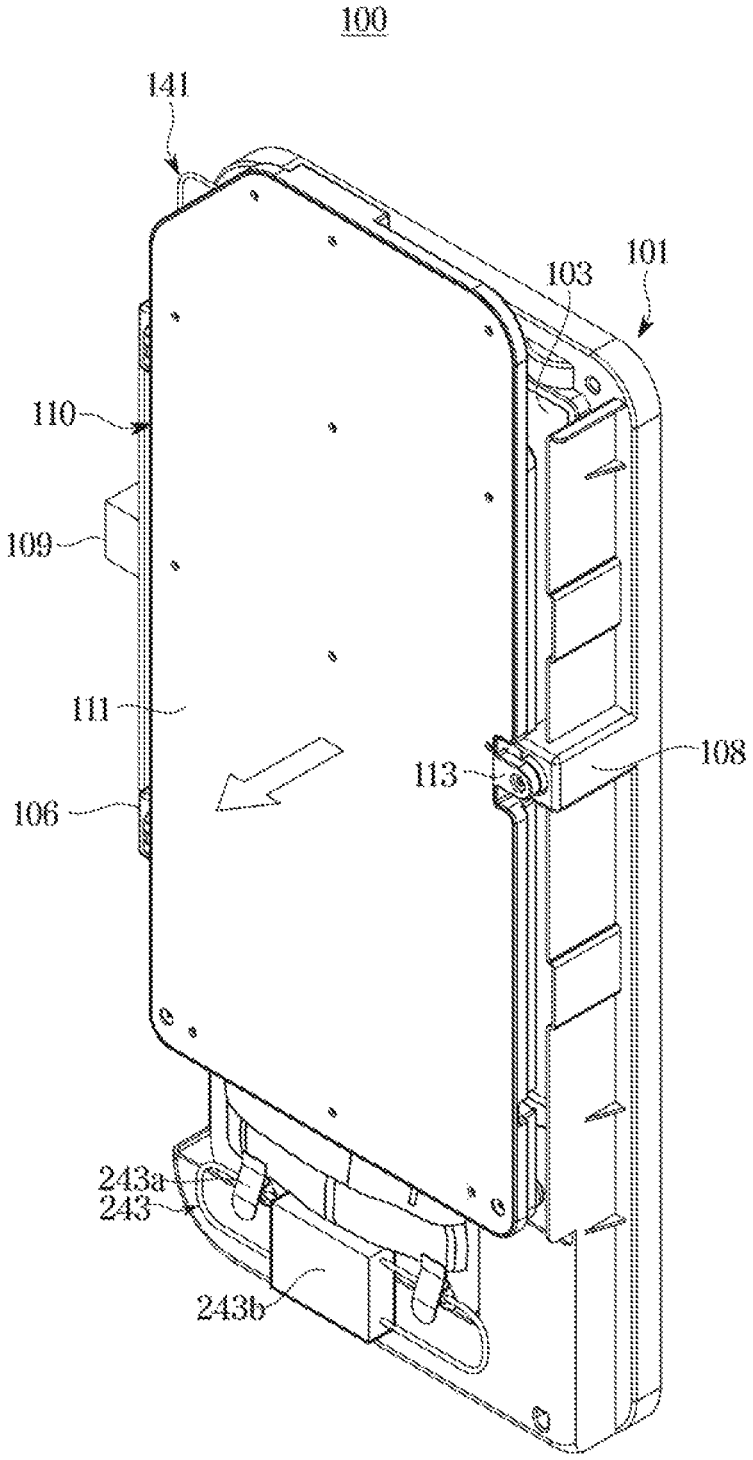

Referring to FIG. 23, once the creation of the crease on the clothes is completed after the clothes is pressed by the press plate 110 and dried by heat, the press plate 110 may be moved away from the base 101. The driving source of the press driver 130 may be rotated in a reverse direction with respect to what is shown in FIG. 21.

Figure 24:
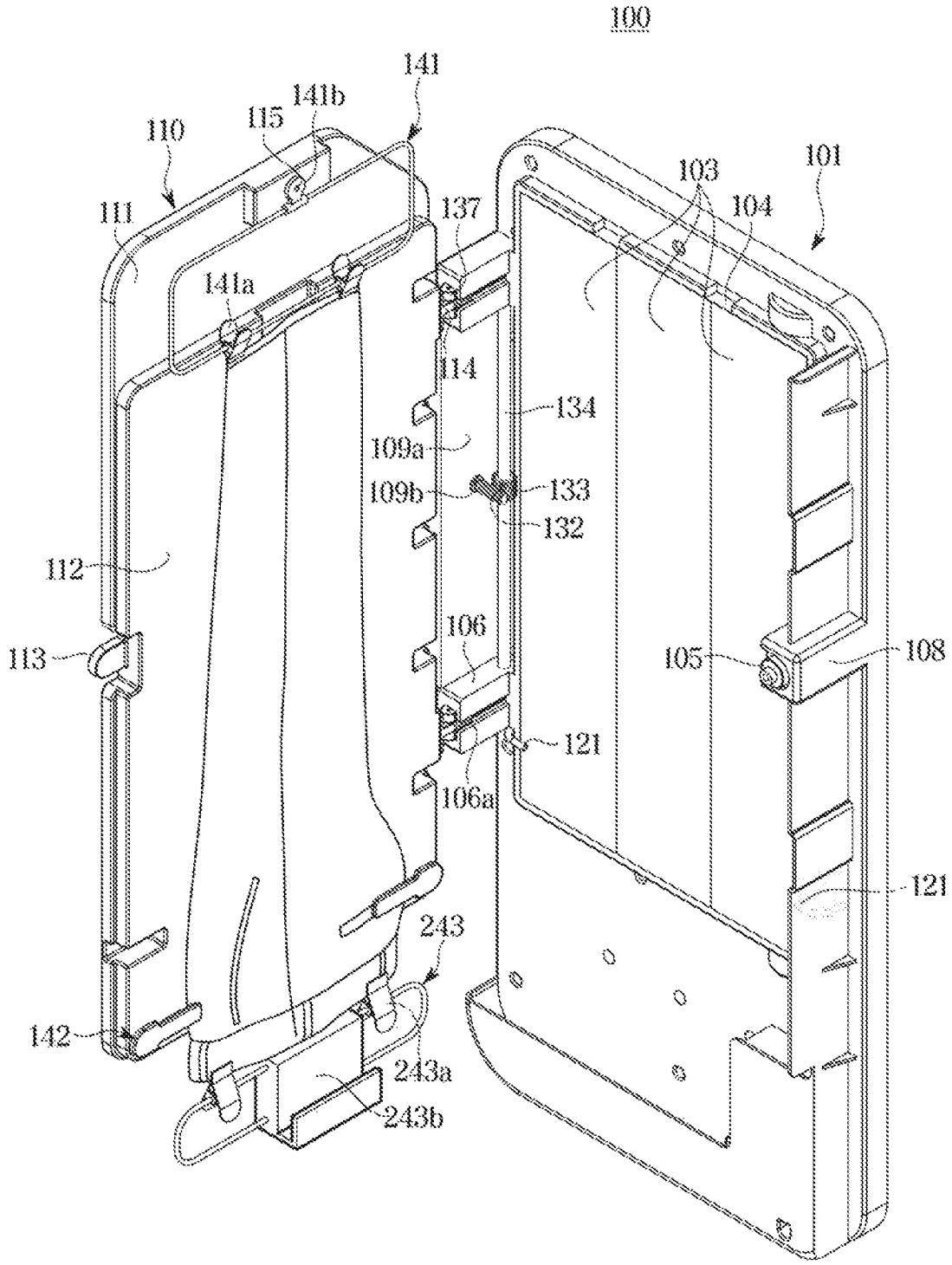

Subsequently, referring to FIG. 24, the press plate 110 may be moved from the first position to the second position while turning against the base 101. When the press plate 110 is in the second position, the user may separate the clothes held on the press plate 110.

Figure 25:
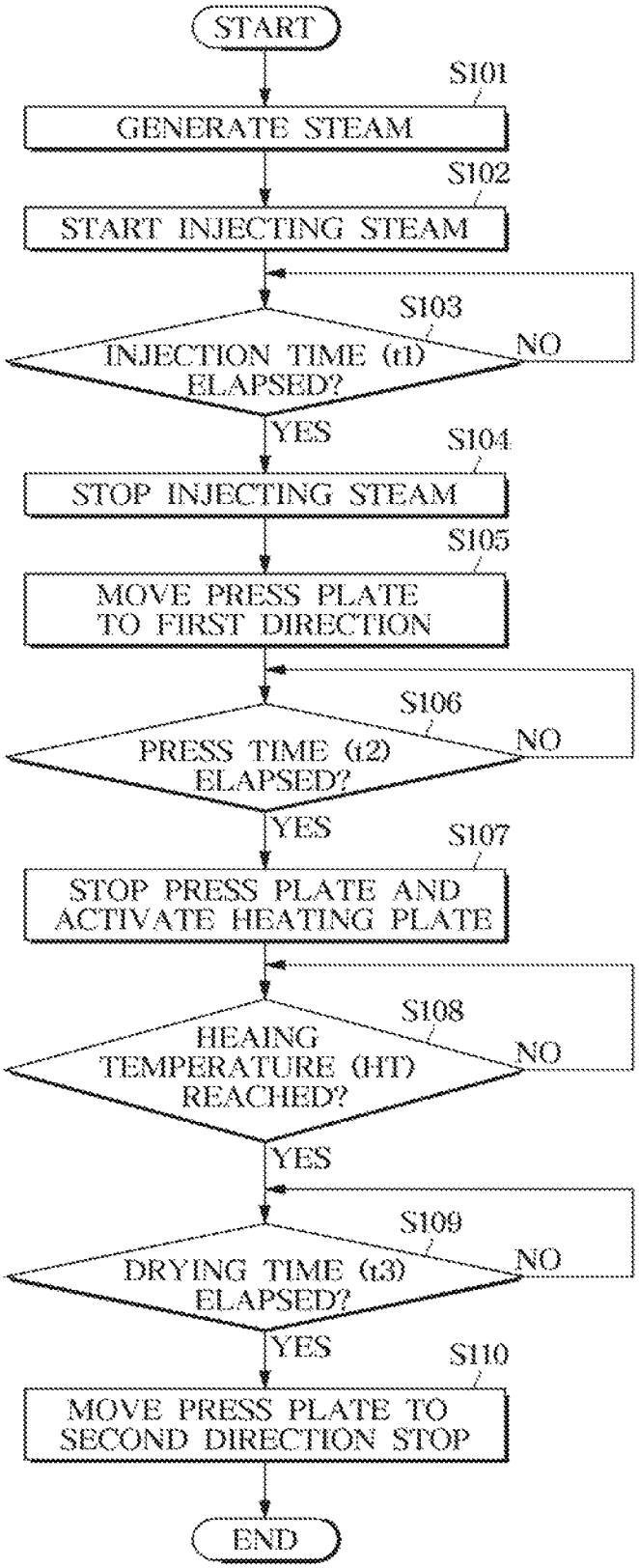
FIG. 25 is a flowchart illustrating a method of performing ironing, by the iron device of the clothes care apparatus shown in FIG. 2, according to an embodiment of the disclosure.
Figure 26:
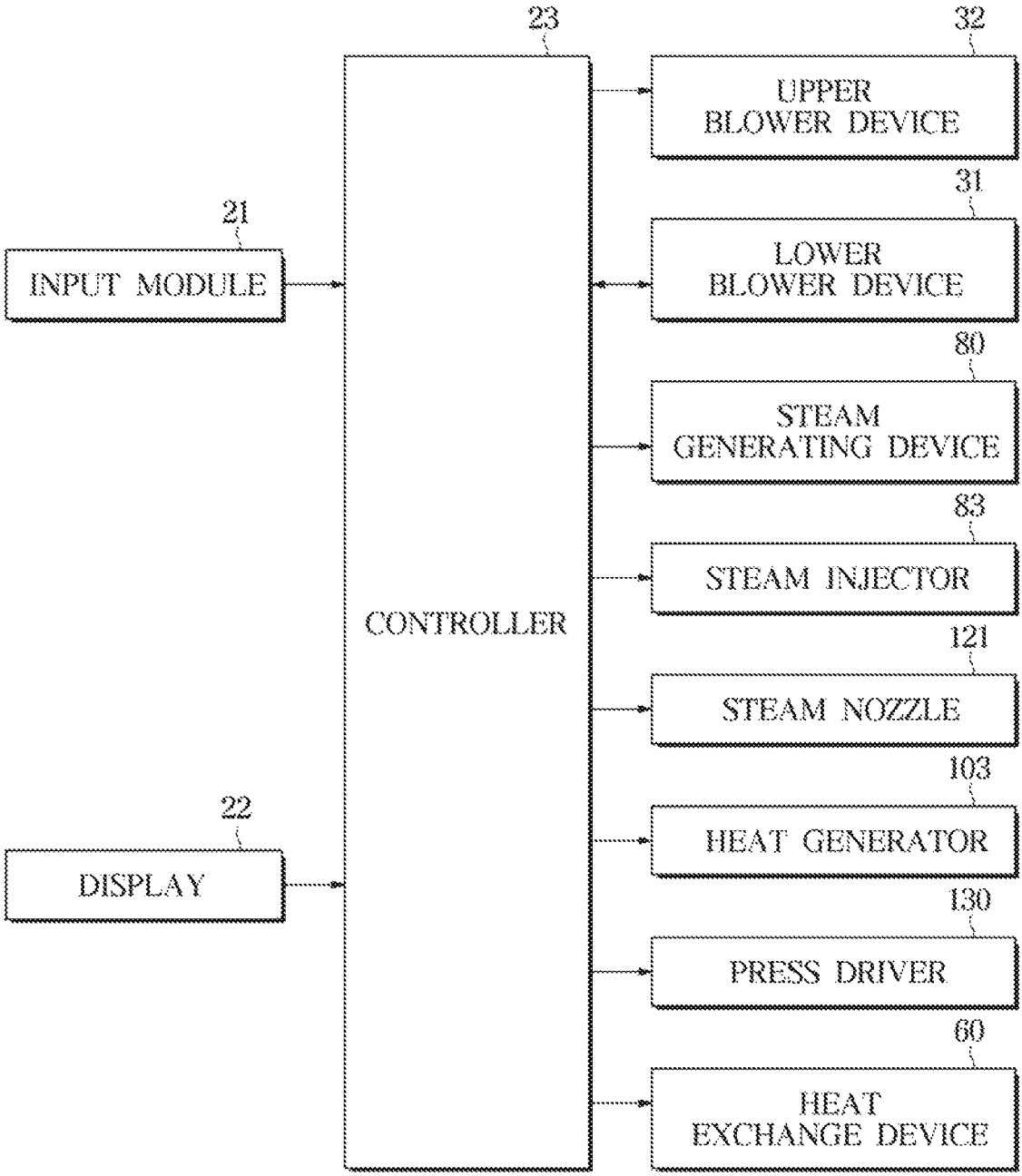
FIG. 26 is a control block diagram of the clothes care apparatus of FIG. 2, according to an embodiment of the disclosure.

FIG. 25 is a flowchart illustrating a method of performing ironing, by the iron device of the clothes care apparatus shown in FIG. 2, according to an embodiment of the disclosure. FIG. 26 is a control block diagram of the clothes care apparatus of FIG. 2, according to an embodiment of the disclosure.

Referring to FIGS. 25 and 26, a method of performing ironing, by the iron device of the clothes care apparatus shown in FIG. 2, will be described in more detail.

When the user wants to create creases on the clothes or remove wrinkles from the clothes, the user may place the clothes on the press plate 110 while putting the press plate 110 in the second position as shown in FIG. 20, and turn the press plate 110 into the first position as shown in FIG. 21 and close the cabinet door 20.

When the user selects a crease creation or wrinkle-free course through the input module 21 on the cabinet door 20, the controller 23 receives the command and controls the steam generating device 80 to generate steam, in S101.

Once a preset amount of steam is generated, the steam is supplied to the space between the press plate 110 and the base 101 through the steam nozzle 121, in S102.

The controller 23 determines whether the steam has been injected as much as the present amount for an injection time t1, in S103. When the preset amount of steam has not been injected for the injection time t1, the steam continues to be injected.

When the preset amount of steam has been injected for the injection time t1, the steam injection is stopped, in S104. The controller 23 moves the press plate 110 toward the base 101 in the first direction as shown in FIG. 22, in S105.

The controller 23 determines whether the press plate 110 has been moved for as much as a preset press time t2, in S106. When the press plate 110 has not been moved for as much as the press time t2, the press plate 110 keeps moving toward the base 101.

When the press plate 110 has been moved for as much as the press time t2, the press plate 110 is stopped and the heat generator 103 is activated, in S107.

The controller determines whether the heat generator 103 reaches a preset heating temperature HT, in S108. When the heat generator 103 has not reached the preset heating temperature HT, the heat generator 103 keeps being heated.

When the heat generator 103 has reached the preset heating temperature HT, the controller 23 determines whether a time from when the preset heating temperature HT is reached reaches a preset drying time t3, in S109. When the drying time t3 has not passed, the heat generator 103 remains at the heating temperature HT.

When the drying time t3 has passed, the controller 23 drives the press driver 130 to move the press plate 110 away from the base 101 in the second direction, in S110.

When the aforementioned crease creation or wrinkle-free course is completed, the user may open the cabinet door 20, turn the press plate 110 into the second position and take out the clothes.

Although the heat generator 103 is heated after the steam injection process and the pressing process with the press plate 110 in the embodiment of the disclosure in connection with FIG. 25, it is not limited thereto. For example, the heat generator 103 may be preheated while the steam is being injected. Specifically, the heat generator 103 may be heated while the steam is being injected, and may have already reached to the heating temperature HT at a time when the press plate 110 moves in the first direction and presses the clothes. In this way, time for performing ironing may be reduced.

Referring to FIG. 26, the clothes care apparatus 1 may include a controller 23 to control the clothes care apparatus 1 as described above. The controller 23 may receive a command from the user through the input module 21. The controller 23 may control the display 22 to display information about an operation of the clothes care apparatus 1.

The controller 23 may control the upper blower device 32, the lower blower device 31, the steam generating device 80, the press driver 130, and the heat exchange device 60. The controller 23 may control the upper blower device 32, the lower blower device 31, the steam generating device 80, the press driver 130, and the heat exchange device 60 based on a control command from the user through the input module 21.

The controller 23 may include the steam injector 83 and the steam nozzle 121. The controller 23 may control the steam generating device 80 and the steam injector 83 to supply steam into the chamber 12*a*, and control the steam generating device 80 and the steam nozzle 121 to supply steam to the iron device 100.

The controller 23 may include at least one memory for storing a program and various types of data to perform the aforementioned operations, and at least one processor for executing the stored program.

When each of the memory and the processor is provided in the plural, they may be integrated in a single chip or provided separately. In embodiments of the disclosure of the clothes care apparatus 1, there are no limitations on the physical arrangement of the memory and the processor.

Figure 27:
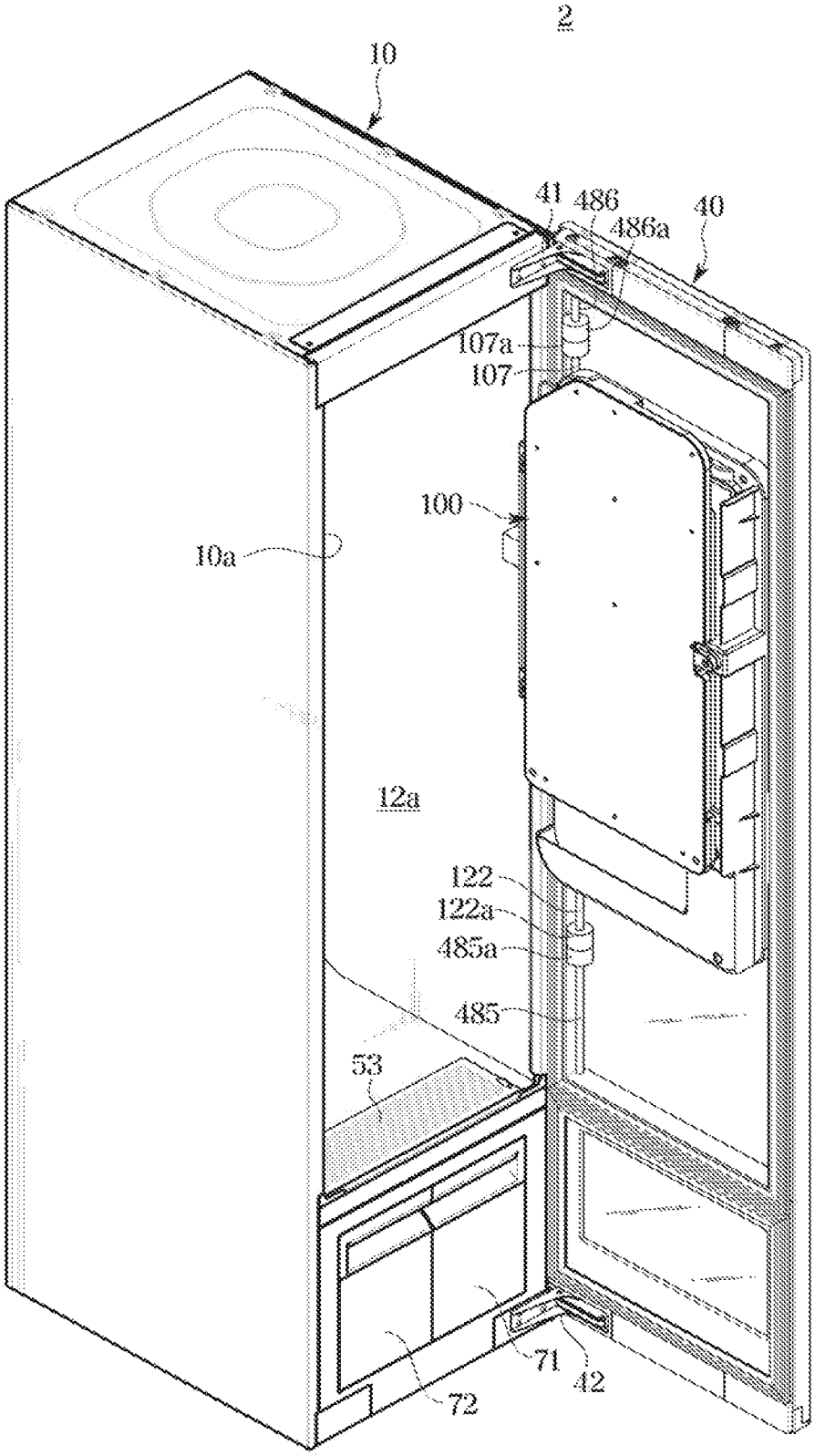
FIG. 27 shows a clothes care apparatus equipped with an iron device, according to another embodiment of the present disclosure.

FIG. 27 shows a clothes care apparatus equipped with an iron device, according to another embodiment of the present disclosure.

Referring to FIG. 27, a clothes care apparatus 2 equipped with the iron device 100 according to another embodiment of the disclosure will be described. The same parts as those in the previous embodiments of the disclosure will have the same reference numerals, and the detailed description thereof will not be repeated.

Referring to FIG. 27, the iron device 100 may be mounted on a cabinet door 40. The structure of the iron device 100 may be equal to that of the iron device 100 shown in FIG. 4.

As the iron device 100 is arranged on the cabinet door 40, a cabinet wire part 486 may be placed to pass through a first cabinet hinge 41 that pivotally supports the top portion of the cabinet door 40, and a cabinet hose 485 may be placed to pass through a second cabinet hinge 42 that pivotally supports the bottom portion of the cabinet door 40.

The cabinet wire part 486 may be coupled to a power part (not shown) arranged in the cabinet 10 and may extend to supply power to the iron device 100. The cabinet wire part 486 may pass through the first cabinet hinge 41 and extend to the cabinet door 40. The cabinet wire part 486 extending to the cabinet door 40 may supply power to the iron device 100 as a cabinet wire connector 486*a* arranged at an end of the cabinet wire part 486 is connected to the base wire connector 107*a* of the base wire part 107.

The cabinet hose 485 may be coupled to the steam generating device 80 arranged in the cabinet 10 and may extend to supply steam to the iron device 100. The cabinet hose 485 may pass through the second cabinet hinge 42 and extend to the cabinet door 40. The cabinet hose 485 extending to the cabinet door 40 may supply steam to the iron device 100 as a cabinet hose connector 485*a* arranged at an end of the cabinet hose 485 is connected to the base hose connector 122*a* of the base hose 122.

With this structure, the clothes care apparatus 2 may perform a crease creation or wrinkle-free course as in the flowchart shown in FIG. 25 even with the iron device 100 arranged on the cabinet door 40.

Figure 28:
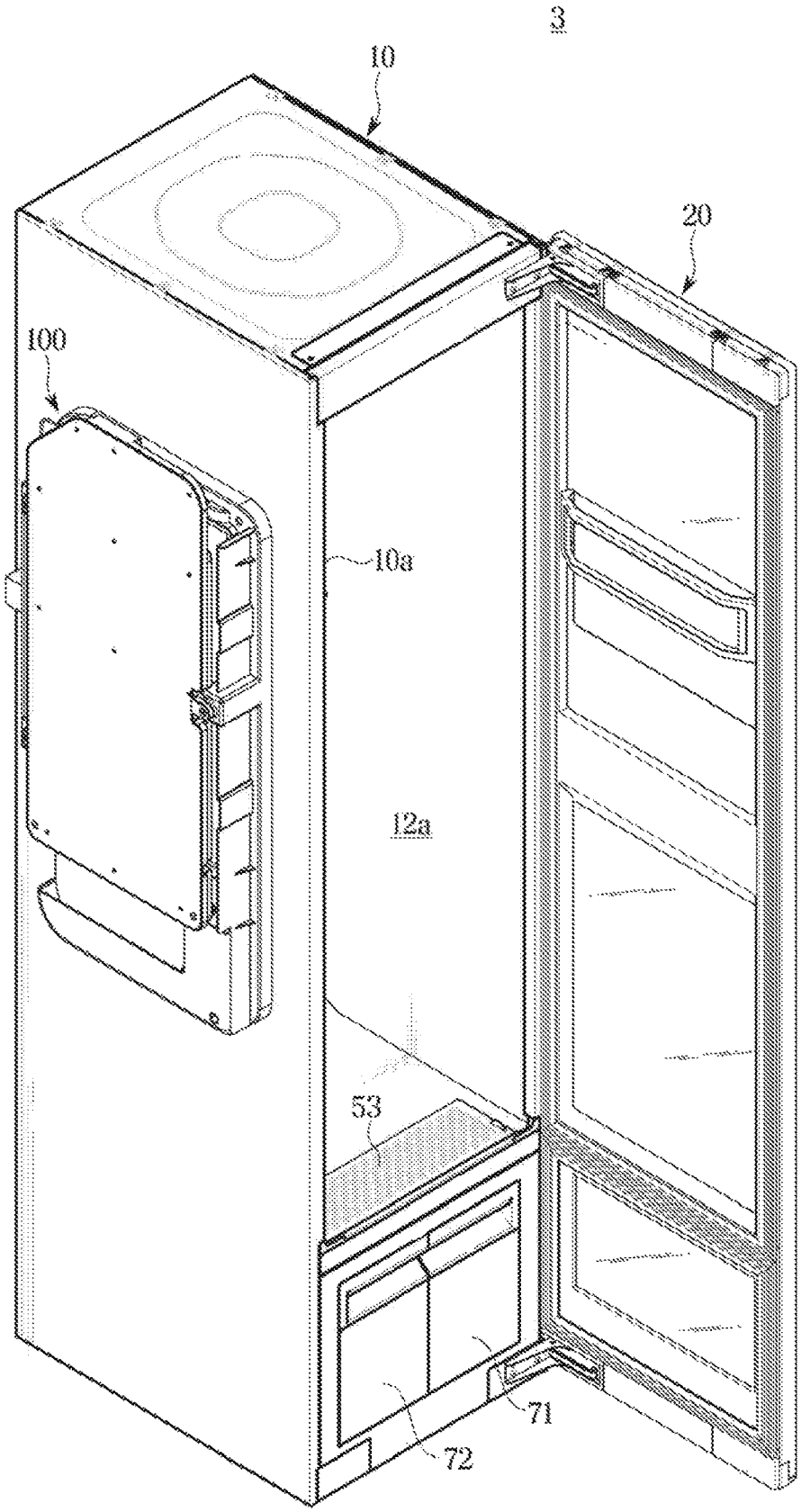
FIG. 28 shows a clothes care apparatus equipped with an iron device, according to another embodiment of the present disclosure.

FIG. 28 shows a clothes care apparatus equipped with an iron device, according to another embodiment of the present disclosure.

Referring to FIG. 28, a clothes care apparatus 3 equipped with the iron device 100 according to another embodiment of the disclosure will be described. The same parts as those in the previous embodiments of the disclosure will have the same reference numerals, and the detailed description thereof will not be repeated.

Referring to FIG. 28, the iron device 100 of the clothes care apparatus 3 may be mounted on an outer side of the cabinet 10. The structure of the iron device 100 may be equal to that of the iron device 100 shown in FIG. 4. The iron device 100 may include a base wire part (not shown) for receiving power from a power part (not shown) arranged in the cabinet 10 and a base hose (not shown), and corresponding to this, the cabinet 10 may include a cabinet wire part (not shown) and a cabinet hose (not shown). Arrangement of the base wire part, the base hose, the cabinet wire part, and the cabinet hose may be similar to what is shown in FIG. 5.

Figure 29:
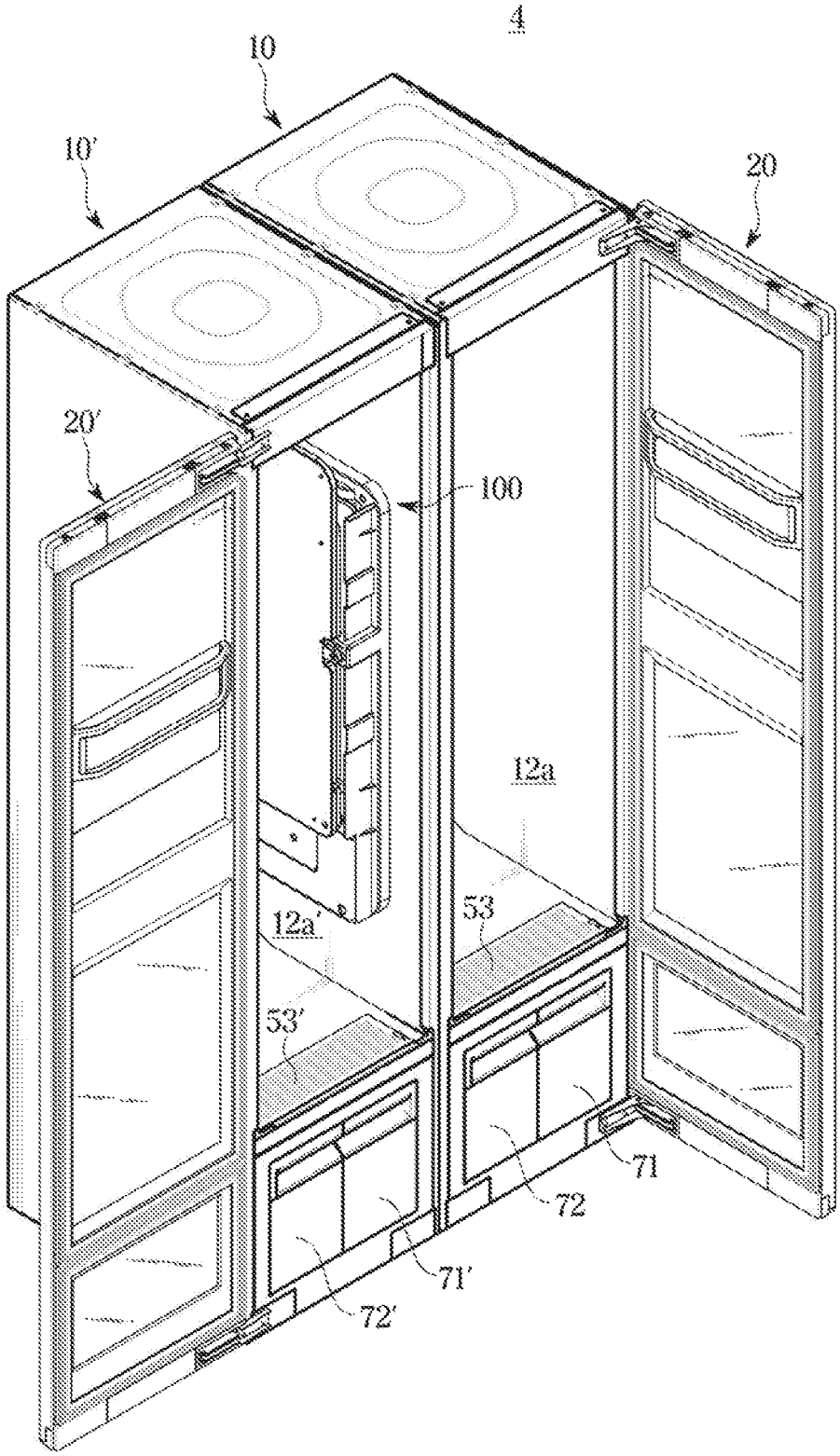
FIG. 29 shows a clothes care apparatus equipped with an iron device, according to another embodiment of the present disclosure.

FIG. 29 shows a clothes care apparatus equipped with an iron device, according to another embodiment of the present disclosure.

Referring to FIG. 29, a clothes care apparatus 4 equipped with the iron device 100 according to another embodiment of the disclosure will be described. The same parts as those in the previous embodiments of the disclosure will have the same reference numerals, and the detailed description thereof will not be repeated.

Referring to FIG. 29, the clothes care apparatus 4 may include a first cabinet 10 not equipped with the iron device 100 and a second cabinet 10' arranged next to the first cabinet 10. The iron device 100 may be arranged inside the second cabinet 10'. The structure of the iron device 100 may be equal to that of the iron device 100 shown in FIG. 4. A module including the first cabinet 10 and a first cabinet door 20 may be called a first module, and a module including the second cabinet 10' and a second cabinet door 20' may be called a second module.

The first module may include a first chamber 12*a* defined by the first cabinet 10 and the first cabinet door 20, an inlet 2*a* 53 formed on the bottom of the first chamber 12*a*, a first supply tub 71 and a first drain tub 72. Although not shown, the first module may include the clothes supporting member 30 as shown in FIG. 3.

The second module may include a second chamber 12*a'* defined by the second cabinet 10' and the second cabinet door 20', an inlet 2*b* 53' formed on the bottom of the second chamber 12*a'*, a second supply tub 71' and a second drain tub 72'. The second module may include an iron device 100.

The second module may be arranged next to the first module. The second module may be operated independently from the first module. The first and second modules may be provided to respectively receive power, and may each include a steam generator (not shown). Alternatively, the clothes care apparatus 4 may include a steam generator to be shared by the first and second modules. For example, a steam generator arranged in the first module is shared by the second module.

As for the clothes care apparatus 4 shown in FIG. 29, the user may purchase and use the first and second modules separately. Specifically, a user who wants to care the clothes with the clothes supporting member without using the iron device 100 may purchase and use the first module only; a user who wants to use the iron device 100 may purchase and use the second module only; a user who requires both the clothes supporting member 30 and the iron device 100 may purchase and use both the first and second modules.

According to embodiments of the disclosure, a clothes care apparatus may be able to supply steam directly to an iron device therein, thereby improving the performance of creating creases on the clothes or removing wrinkles from the clothes.

Furthermore, the clothes care apparatus may be equipped with a heat generator in the iron device, thereby improving the performance of creating creases on the clothes or removing wrinkles from the clothes.

Several embodiments of the disclosure have been described above, but a person of ordinary skill in the art will understand and appreciate that various modifications can be made without departing the scope of the disclosure. Thus, it will be apparent to those ordinary skilled in the art that the true scope of technical protection is only defined by the following claims.

What is claimed is:

1. An iron device comprising:

a base provided with a heat generator;

a press plate arranged to pivot between a first position at which the press plate covers the base and a second position at which the press plate uncovers the base;

a steam nozzle arranged to, with the press plate being in the first position, supply steam to a space between the base and the press plate;

a press driver configured to, with the press plate being in the first position, mechanically move the press plate in a first direction toward the base and a second direction away from the base;

a first clothes fixing member located at one side portion of the press plate to fix an end of a clothes to be ironed by the iron device; and a second clothes fixing member located at another side portion of the press plate to fix a portion of the clothes.

2. The iron device of claim 1, wherein the heat generator is arranged so that, with the press plate being in the first position, the heat generator faces the press plate.

3. The iron device of claim 1, wherein the steam nozzle is provided in the form of a steam injection hole passing through the base or the press plate.

4. The iron device of claim 1, wherein the first clothes fixing member is located at a top portion of the press plate, and the second clothes fixing member is movably arranged at a bottom portion of the press plate.

5. The iron device of claim 4, further comprising:

a third clothes fixing member arranged to fasten a bottom portion of the clothes fixed by the first and second clothes fixing members and including a forcing member.

6. The iron device of claim 1, wherein the press plate has a first end and a second end opposite to the first end, the first end of the press plate is coupled to the press driver, the base comprises a plate fixing member arranged to, with the press plate being in the first position, fix the second end of the press plate, and the plate fixing member is provided to be movable along with the press plate when the press plate is moved in the first and second directions.

7. The iron device of claim 1, wherein the press plate comprises a cushion part arranged to, with the press plate being in the first position, be on a side of the press plate facing the base.

8. The iron device of claim 1, wherein the base comprises a press guide arranged to guide movement of the press plate in the first and second directions.

9. The iron device of claim 1, wherein the press driver comprises:

a driving source, a first gear to receive power from the driving source, a second gear interlocked with the first gear, a pinion gear arranged to be rotated with the second gear, a rack gear interlocked with the pinion gear, and a press hinge arranged at an end of the rack gear to pivotally support the press plate.

10. The iron device of claim 1, wherein the press driver is configured to pivotally support the press plate.

11. The iron device of claim 1, further comprising:

at least one processor configured to control the press driver to move the press plate in the first direction and the second direction.

12. A clothes care apparatus comprising:

a housing defining a chamber to contain a clothes; and an iron device detachably mountable on the housing, wherein the iron device comprises:

a base that, with the iron device being mounted on the housing, is supported by the housing, a press plate that, with the iron device being mounted on the housing, is arranged to pivot between a first position at which the press plate covers the base and a second position at which the press plate uncovers the base, and a press driver that, with the iron device being mounted on the housing, is configured to pivotally support the press plate, and to, with the press plate being in the first position, move the press plate in a first direction toward the base and a second direction away from the base.

13. The clothes care apparatus of claim 12, wherein the base comprises a heat generator arranged so that, with the iron device being mounted on the housing and the press plate being in the first position, the heat generator faces the press plate.

14. The clothes care apparatus of claim 12, further comprising:

a steam generating device, wherein, with the iron device being mounted on the housing, the iron device is arranged to receive steam generated by the steam generating device.

15. The clothes care apparatus of claim 14, wherein the iron device comprises a steam nozzle arranged to, with the iron device being mounted on the housing and the press plate being in the first position, supply the received steam to a space between the press plate and the base.

16. The clothes care apparatus of claim 14, wherein at least one of the base or the press plate comprises a steam injection hole arranged to, with the iron device being mounted on the housing and the press plate being in the first position, supply the received steam to a space between the press plate and the base.

17. The clothes care apparatus of claim 12, wherein the housing comprises a reinforcing frame arranged in a portion of the housing in which the iron device is mountable.

18. The clothes care apparatus of claim 12, wherein the housing comprises a cabinet and a cabinet door pivotally coupled to the cabinet, and the iron device is mountable on an inner side of the cabinet, an outer side of the cabinet, or the cabinet door.

19. The clothes care apparatus of claim 18, wherein the iron device, when mounted on the cabinet door, comprises a wire part to supply power to the iron device, and arranged to pass through a first cabinet hinge which pivotally supports the cabinet door, and a steam hose to supply steam to the iron device, and arranged to pass through a second cabinet hinge which pivotally supports the cabinet door.

20. A clothes care apparatus comprising:

a housing defining a chamber to contain a clothes;

a steam generating device arranged in the housing and configured to generate steam; and an iron device detachably mountable on the housing, wherein the iron device comprises:

a base provided with a heat generator and that, with the iron device being mounted on the housing, is supported by the housing, a press plate that, with the iron device being mounted on the housing, is arranged to be movable in a first direction toward the base and a second direction away from the base, a press driver that, with the iron device being mounted on the housing, is arranged to mechanically move the press plate, and a steam nozzle that, with the iron device being mounted on the housing, is arranged to receive the steam generated by the steam generating device and inject the received steam between the base and the press plate from a side of the housing on which the base is supported.

* * * * *